US010866537B2

(12) United States Patent
Nieda et al.

(10) Patent No.: US 10,866,537 B2
(45) Date of Patent: Dec. 15, 2020

(54) POWDER CONTAINER HAVING CONTACT PORTION TO CONTACT A RESTRICTION MEMBER

(71) Applicants: Hiroaki Nieda, Kanagawa (JP); Kuniyori Takano, Tokyo (JP); Shinichi Arasawa, Kanagawa (JP)

(72) Inventors: Hiroaki Nieda, Kanagawa (JP); Kuniyori Takano, Tokyo (JP); Shinichi Arasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/292,442

(22) Filed: Mar. 5, 2019

(65) Prior Publication Data

US 2019/0286011 A1 Sep. 19, 2019

(30) Foreign Application Priority Data

Mar. 13, 2018 (JP) ..... 2018-045502
Dec. 3, 2018 (JP) ..... 2018-226557

(51) Int. Cl.
*G03G 21/18* (2006.01)
*G03G 15/08* (2006.01)

(52) U.S. Cl.
CPC ..... *G03G 15/0886* (2013.01); *G03G 21/1814* (2013.01); *G03G 21/1821* (2013.01);
(Continued)

(58) Field of Classification Search
CPC ..... G03G 15/0886; G03G 21/1814; G03G 15/0867; G03G 21/16; G03G 15/0875;
(Continued)

(56) References Cited

U.S. PATENT DOCUMENTS

2009/0154972 A1* 6/2009 Tanaka ..... G03G 21/105 399/358
2016/0109827 A1 4/2016 Yoshida et al.
(Continued)

FOREIGN PATENT DOCUMENTS

JP 2005-242185 9/2005
JP 2011-008114 1/2011
(Continued)

*Primary Examiner* — Walter L Lindsay, Jr.
*Assistant Examiner* — Laura Roth
(74) *Attorney, Agent, or Firm* — Oblon, McClelland, Maier & Neustadt, L.L.P.

(57) ABSTRACT

A powder container includes a discharge port configured to discharge powder stored in the powder container, a container shutter configured to open and close the discharge port, a first rotation portion configured to be engageable with an engagement portion of a removable component, an operation device configured to rotate the first rotation portion in conjunction with an operation of the operation device, and a contact portion included in the first rotation portion. The engagement portion opens and closes a cartridge shutter to open and close an inlet port of the removable component. A restriction member of the removable component is configured to restrict the rotation of the engagement portion. The contact portion contacts the restriction member to cancel the restriction member from restricting rotation of the engagement portion in conjunction with attachment of the powder container to the removable component.

16 Claims, 22 Drawing Sheets

(52) U.S. Cl.
CPC . *G03G 15/0875* (2013.01); *G03G 2215/0668* (2013.01); *G03G 2215/0692* (2013.01); *G03G 2221/1612* (2013.01)

(58) Field of Classification Search
CPC ..... G03G 21/1832; G03G 21/1821; G03G 2215/0668; G03G 2215/0673; G03G 2215/068; G03G 2215/0692; G03G 2221/1612
See application file for complete search history.

(56) References Cited

U.S. PATENT DOCUMENTS

| | | | | |
|---|---|---|---|---|
| 2017/0285529 | A1* | 10/2017 | Nishiyama ..... | G03G 15/0877 |
| 2018/0267459 | A1* | 9/2018 | Sato ..... | G03G 21/1821 |

FOREIGN PATENT DOCUMENTS

| | | |
|---|---|---|
| JP | 2013-232019 | 11/2013 |
| JP | 2015-031865 | 2/2015 |
| JP | 2017-062515 | 3/2017 |

* cited by examiner

POWDER CONTAINER HAVING CONTACT PORTION TO CONTACT A RESTRICTION MEMBER

CROSS-REFERENCE TO RELATED APPLICATIONS

This patent application is based on and claims priority pursuant to 35 U.S.C. § 119(a) to Japanese Patent Application Nos. 2018-045502, filed on Mar. 13, 2018 and 2018-226557, filed on Dec. 3, 2018, in the Japan Patent Office, the entire disclosure of each of which is hereby incorporated by reference herein.

BACKGROUND

Technical Field

This disclosure generally relates to a powder container attachable to and detachable from a body of an image forming apparatus or a process cartridge, the process cartridge including the powder container, and the image forming apparatus, such as a copier, a printer, a facsimile machine, or a multifunction peripheral (MFP) having such functions.

Description of the Related Art

There is known an image forming apparatus, such as a copier, a printer, and a facsimile machine, including a toner container (a powder container), which is attachable to and detachable from a body of the image forming apparatus or a process cartridge (a removable component), to store toner (powder).

SUMMARY

According to embodiments of the present disclosure, an improved powder container is configured to be attached to and detached from one of a body of an image forming apparatus and a removable component to be installed in and removed from the body of the image forming apparatus. The powder container includes a discharge port configured to discharge powder stored in the powder container, a container shutter configured to open and close the discharge port, a first rotation portion configured to be engageable with an engagement portion of the one of the body and the removable component, a second rotation portion, a shaft configured to couple the first rotation portion and the second rotation portion, an operation device configured to rotate the first rotation portion in conjunction with an operation of the operation device via the second rotation portion and the shaft, and a contact portion included in the first rotation portion. The discharge port is configured to communicate with an inlet port of the one of the body and the removable component. The engagement portion is configured to open and close a cartridge shutter to open and close the inlet port through which the powder flows in. The restriction member of the one of the body and the removable component is configured to restrict the rotation of the engagement portion. The contact portion is configured to contact the restriction member to cancel the restriction member from restricting rotation of the engagement portion in conjunction with attachment of the powder container to the one of the body and the removable component.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
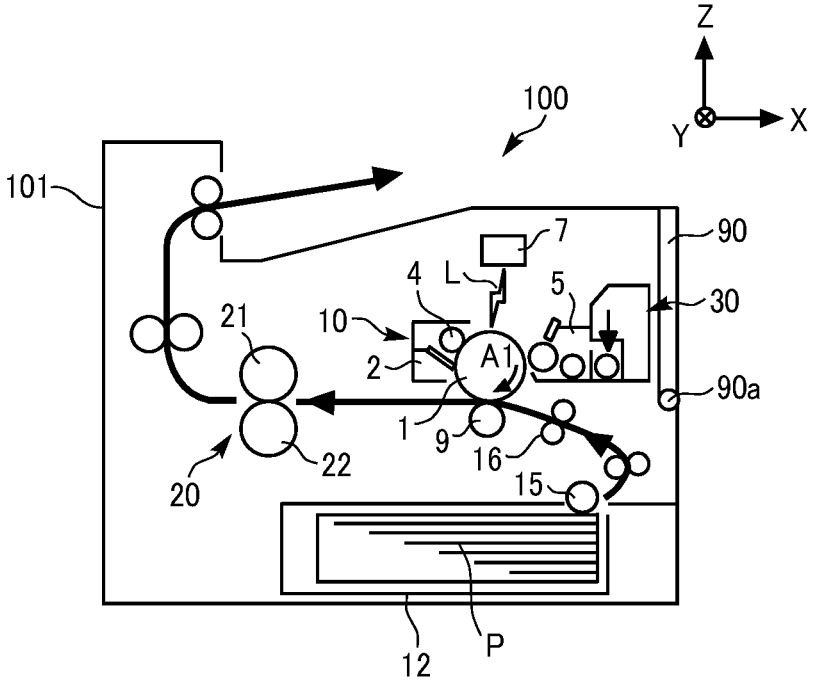
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

With reference to the drawings, embodiments of the present disclosure are described below. It is to be understood that identical or similar reference numerals are assigned to identical or corresponding components throughout the drawings, and redundant descriptions are omitted or simplified below as appropriate.

Now, a description is given of a configuration and operation of an image forming apparatus 100 with reference to FIG. 1.

In FIG. 1, the image forming apparatus 100 that is a printer in the present embodiment includes a photoconductor drum 1, on which a toner image is formed, and an exposure device (a writing device) 7. The exposure device 7 irradiates the photoconductor drum 1 with exposure light L based on image data input from an input device such as a personal computer.

The image forming apparatus 100 further includes: a transfer roller 9 to transfer the toner image borne on a surface of the photoconductor drum 1 to a sheet P conveyed to a transfer nip (a transfer position); a process cartridge 10 in which the photoconductor drum 1, a charging roller 4, a developing device 5, a cleaner 2, and a waste toner conveyor 6 (see FIG. 2) are united; and a sheet feeder (a sheet tray) 12 to accommodate the sheets P such as paper sheets.

The image forming apparatus 100 yet further includes a registration roller pair (a timing roller pair) 16 to feed the sheet P toward the transfer nip where the photoconductor drum 1 contacts the transfer roller 9, a fixing device 20 to fix an unfixed image on the sheet P, and a toner container (a powder container) 30. The fixing device 20 includes a fixing roller 21 and a pressure roller 22.

Around the photoconductor drum 1, the charging roller 4, the developing device 5, the cleaner 2, and the waste toner conveyor 6 are disposed. The above components (i.e., the photoconductor drum 1, the charging roller 4, the developing device 5, the cleaner 2, and the waste toner conveyor 6) are united as the process cartridge 10. The process cartridge 10 is removably installed in a body 101 of the image forming apparatus 100. The process cartridge 10 is replaced with a new process cartridge in a certain replacement cycle.

Above the process cartridge 10 (the developing device 5) as a removable component, the toner container 30 as the powder container is removably (replaceably) installed in the body 101 of the image forming apparatus 100. The toner container 30 (a toner storage 31) stores toner (fresh toner) as powder. The toner is appropriately supplied from the toner container 30 to the inside of the developing device 5. When the toner container 30 runs out of toner (or toner contained in the developing device 5 is depleted), the toner container 30 is replaced with a new toner container. Note that, the toner container 30 according to the present embodiment further includes a waste toner collection portion (a powder collection portion) 32 in addition to the toner storage (a powder storage) 31. The waste toner collection portion 32 is described in detail later.

Figure 2:
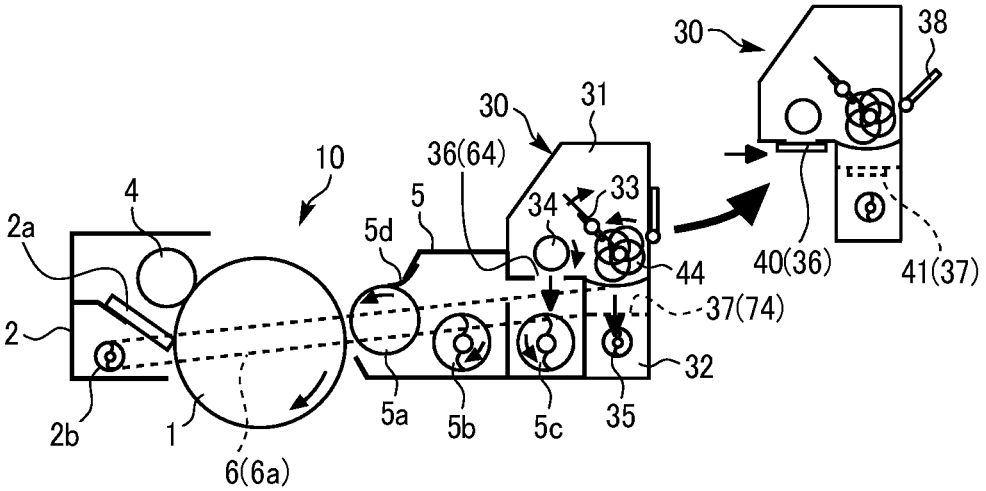
FIG. 2 is a schematic view of a process cartridge and a toner container according to an embodiment of the present disclosure.

Now, a description is given of regular image forming operations performed by the image forming apparatus 100 with reference to FIGS. 1 and 2.

With reference to FIG. 1, as image data is transmitted from the input device, such as a personal computer, to the exposure device 7 in the image forming apparatus 100, the exposure device 7 irradiates the surface of the photoconductor drum 1 with the exposure light (a laser beam) L based on the image data.

Meanwhile, the photoconductor drum 1 rotates in a direction indicated by arrow A1 in FIG. 1, that is, a clockwise direction. The charging roller 4 uniformly charges the surface of the photoconductor drum 1 at a position opposed to the photoconductor drum 1 (a charging process). As a result, a charging potential is formed on the surface of the photoconductor drum 1. In the present embodiment, the charging potential on the photoconductor drum 1 is approximately −900V. The charged surface of the photoconductor drum 1 thereafter reaches an irradiation position of the exposure light L. An irradiated portion of the photoconductor drum 1 with the exposure light L has a latent image potential (about 0 to −100 V), and an electrostatic latent image is formed on the surface of the photoconductor drum 1 (an exposure process).

The surface of the photoconductor drum 1 bearing the electrostatic latent image thereon reaches a position where the photoconductor drum 1 is opposed to the developing device 5. The developing device 5 supplies toner onto the photoconductor drum 1, and the latent image formed on the photoconductor drum 1 is thereby developed into a toner image (a developing process).

As illustrated in FIG. 2, the developing device 5 includes a developing roller 5*a*, two development conveying screws 5*b* and 5*c*, and a doctor blade 5*d*. The developing device 5 contains toner (a one-component developer). Toner is supplied from a discharge port 36 of the toner container 30 (the toner storage 31) to the developing device 5 via an inlet port 64 of the developing device 5 according to consumption of toner in the developing device 5. The two development conveying screws 5*b* and 5*c* stir and mix the supplied toner with the toner contained in the developing device 5 while circulating the toner in a longitudinal direction of the developing device 5, which is a direction perpendicular to the surface of the paper on which FIG. 2 is drawn. The developing roller 5*a* scoops up a part of the toner conveyed by the development conveying screw 5*b*. The toner scooped up by the developing roller 5*a* is quantified by the doctor blade 5*d* and reaches a position (a development range) opposed to the photoconductor drum 1. At that time, the toner on the developing roller 5*a* is rubbed by the doctor blade 5*d* and triboelectrically charged. The quantified toner adheres to the electrostatic latent image on the photoconductor drum 1 at the development range, thereby forming the toner image on the photoconductor drum 1. The developing roller 5*a* and the two development conveying screws 5*b* and 5*c* are rotated in directions indicated by arrows in FIG. 2 by a drive motor included in the image forming apparatus 100, respectively.

After the developing process, the surface of the photoconductor drum 1 bearing the toner image thereon reaches the transfer nip (the transfer position) formed between the photoconductor drum 1 and the transfer roller 9. In the transfer nip between the photoconductor drum 1 and the transfer roller 9, a transfer bias, which has a polarity opposite to toner, is applied from a power source to the transfer roller 9, and the toner image formed on the photoconductor drum 1 is thereby transferred onto the sheet P fed by the registration roller pair 16 (a transfer process).

The surface of the photoconductor drum 1 after the transfer process reaches a position opposed to the cleaner 2. At this position, untransferred toner remaining on the surface of the photoconductor drum 1 is mechanically removed by a cleaning blade 2*a* and collected in the cleaner 2 (a cleaning process).

A series of image forming processes on the photoconductor drum 1 is thus completed.

A collection screw 2*b* conveys the untransferred toner collected in the cleaner 2 to one end of the cleaner 2 in a width direction (a rotation axis direction) of the collection screw 2*b*. The waste toner conveyor 6 including a waste toner coil 6*a* conveys the untransferred toner in a diagonally upper right direction in FIG. 2. Thus, the untransferred toner is collected in the waste toner collection portion 32 of the toner container 30 as waste toner from an outlet port 74 of the waste toner conveyor 6 via a collection port 37 of the toner container 30.

In the new toner container 30, the toner storage 31 is filled with fresh toner, and the waste toner collection portion 32 is empty.

The sheet P is conveyed to the transfer nip (i.e., the transfer position) between the photoconductor drum 1 and the transfer roller 9 as follows.

First, a feed roller 15 feeds the topmost sheet P of the stack of sheets P accommodated in the sheet feeder 12 toward a conveyance path.

Thereafter, the sheet P reaches the registration roller pair 16. The sheet P that has reached the registration roller pair 16 is fed to the transfer nip (i.e., the contact position of the transfer roller 9 with the photoconductor drum 1) in synchronization with an entry of the toner image formed on the photoconductor drum 1 into the transfer nip.

After the transfer process, the sheet P passes through the transfer nip (i.e., the position of the transfer roller 9) and reaches the fixing device 20 through the conveyance path. In the fixing device 20, the sheet P is interposed between the fixing roller 21 and the pressure roller 22. The toner image is fixed on the sheet P by heat applied from the fixing roller 21 and pressure which is applied from both the fixing roller 21 and the pressure roller 22. The sheet P having the fixed toner image thereon is discharged from the fixing nip formed between the fixing roller 21 and the pressure roller 22, ejected from the body 101 of the image forming apparatus 100, and stacked on an output tray.

Accordingly, a series of the image forming processes is completed.

Figure 3A:
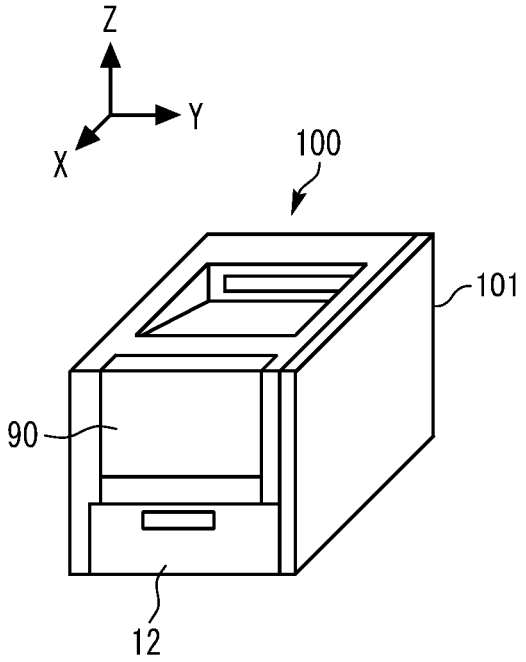
FIG. 3A is a perspective view of the image forming apparatus with a cover closed according to an embodiment of the present disclosure.
Figure 3B:
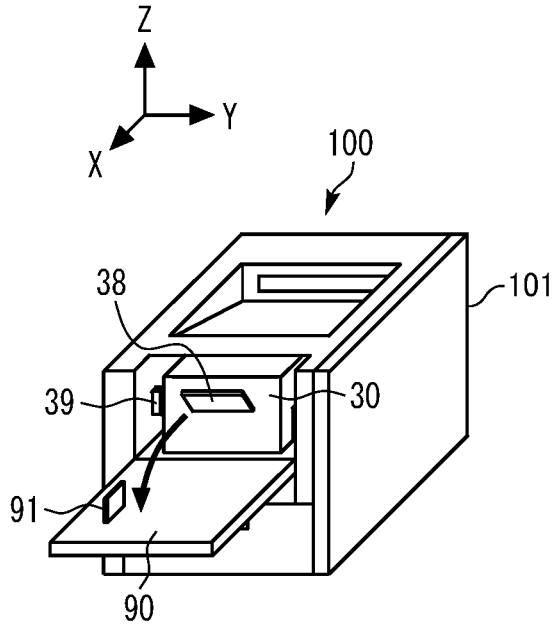
FIG. 3B is a perspective view of the image forming apparatus with the cover open according to an embodiment of the present disclosure.

According to the present embodiment, the image forming apparatus 100 is covered with a plurality of exterior covers as illustrated in FIG. 3A. As illustrated in FIG. 3B, a part of a front exterior cover functions as a cover 90 that is rotatable.

More specifically, the cover 90 is secured to the image forming apparatus 100 and hinged around a spindle (a rotation center shaft) 90*a* as illustrated in FIG. 1. As the cover 90 rotates counterclockwise in FIG. 1 around the spindle 90*a*, the cover 90 closes as illustrated in FIGS. 1 and 3A. As the cover 90 rotates clockwise in FIG. 1 around the spindle 90*a*, the cover 90 opens as illustrated in FIG. 3B.

In the present embodiment, as illustrated in FIG. 3B, the toner container (the powder container) 30 is exposed to be installable in and removable from the image forming apparatus 100 when the cover 90 opens. By opening the cover 90, the toner container 30 alone (illustrated in FIG. 7) can be replaced with a new toner container, or the toner container 30 together with the process cartridge 10 can be replaced with a new one (the process cartridge 10 and the toner container 30 illustrated in FIG. 4).

Image forming processes (printing operations) described above with reference to FIG. 1 are performed when the cover 90 closes as illustrated in FIG. 1.

The configuration and operation of the toner container (the powder container) 30 according to the present embodiment are described in further detail below.

In the present embodiment, as illustrated in FIG. 2, the toner container 30 as the powder container is attachable to and detachable from the process cartridge 10. In particular, in the present embodiment, the toner container 30 is attachable to and detachable from the process cartridge 10 in both states in which the process cartridge 10 is installed in the image forming apparatus 100 and in which the process cartridge 10 is removed from the image forming apparatus 100.

As described above with reference to FIG. 3B, the toner container 30 is attachable to and detachable from the process cartridge 10 installed in the image forming apparatus 100. In other words, the toner container 30 as the powder container is indirectly installable in and removable from the image forming apparatus 100.

In the present embodiment, the toner container 30 is indirectly installable in and removable from the image forming apparatus 100. Alternatively, the toner container 30 is directly installable in and removable from the image forming apparatus 100.

The process cartridge 10 is the removable component that is installable in and removable from the image forming apparatus 100. Besides the process cartridge 10, the developing device 5 and other devices can function as the removable components. The toner container (the powder container) 30 is attachable to and detachable from a removable component other than the process cartridge 10.

Figure 4:
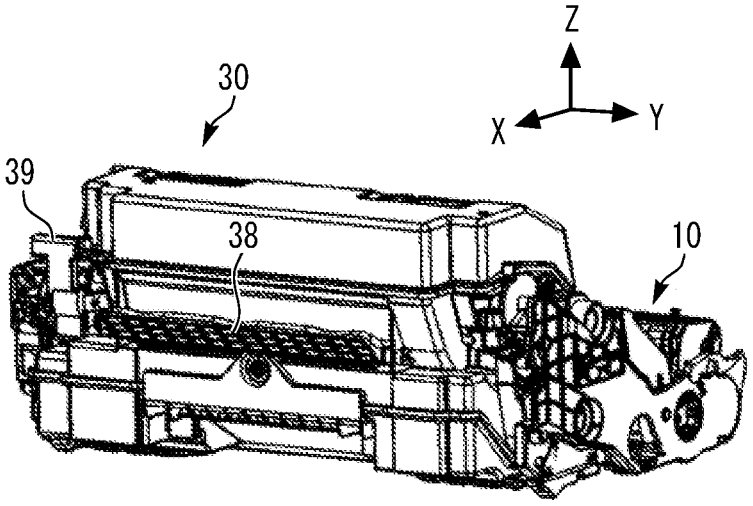
FIG. 4 is a perspective view of the process cartridge to which the toner container is attached.
Figure 5:
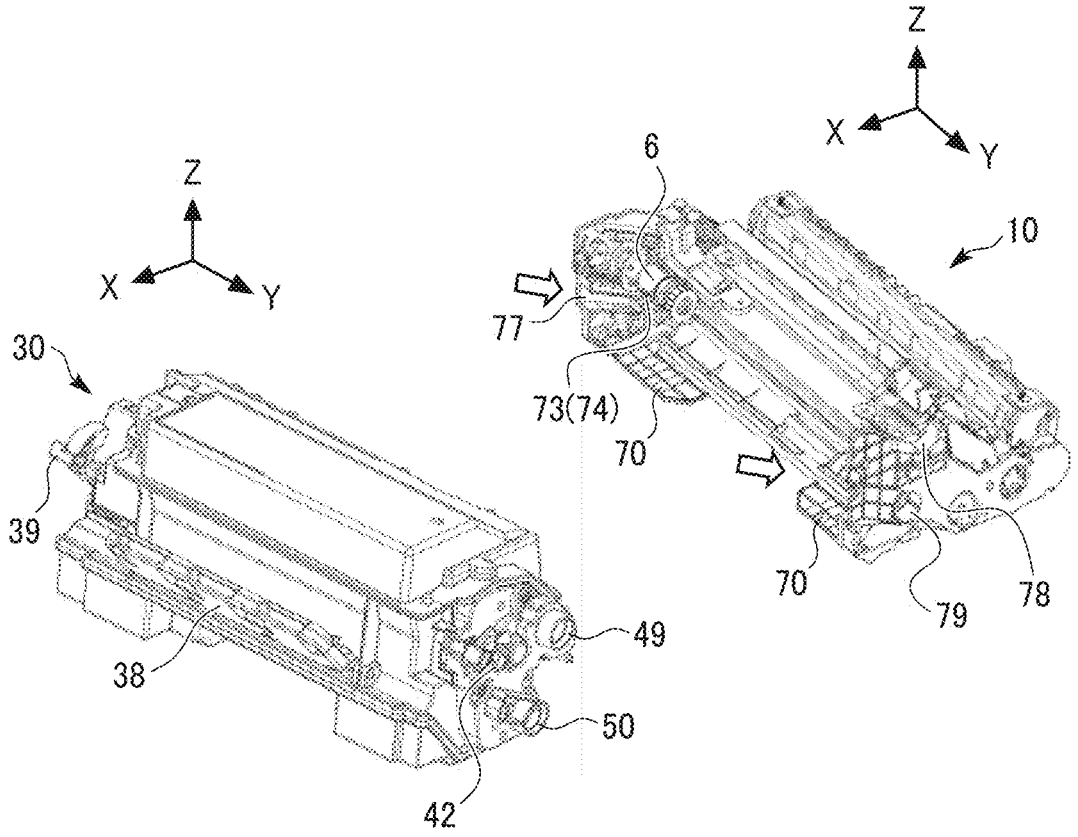
FIG. 5 is a perspective view of the process cartridge from which the toner container is detached.
Figure 6A:
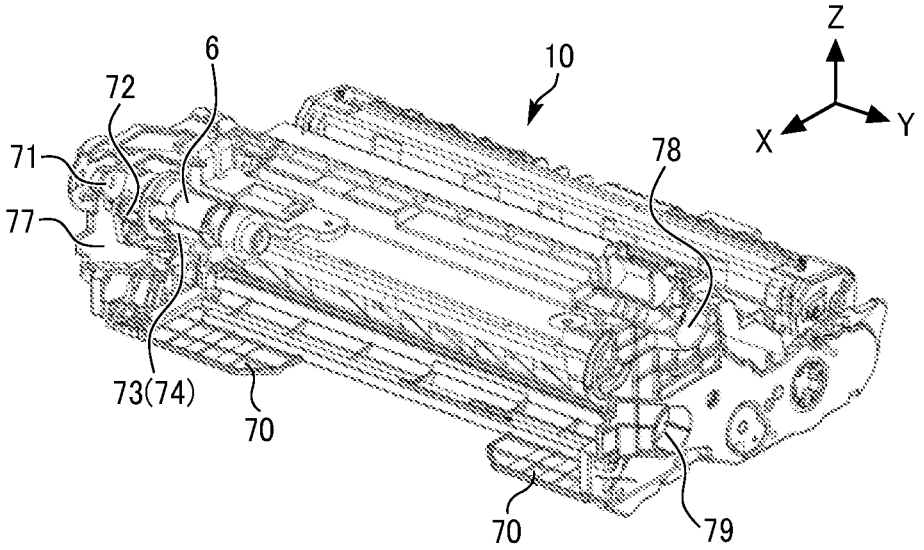
FIGS. 6A and 6B are perspective views of the process cartridge.
Figure 6B:
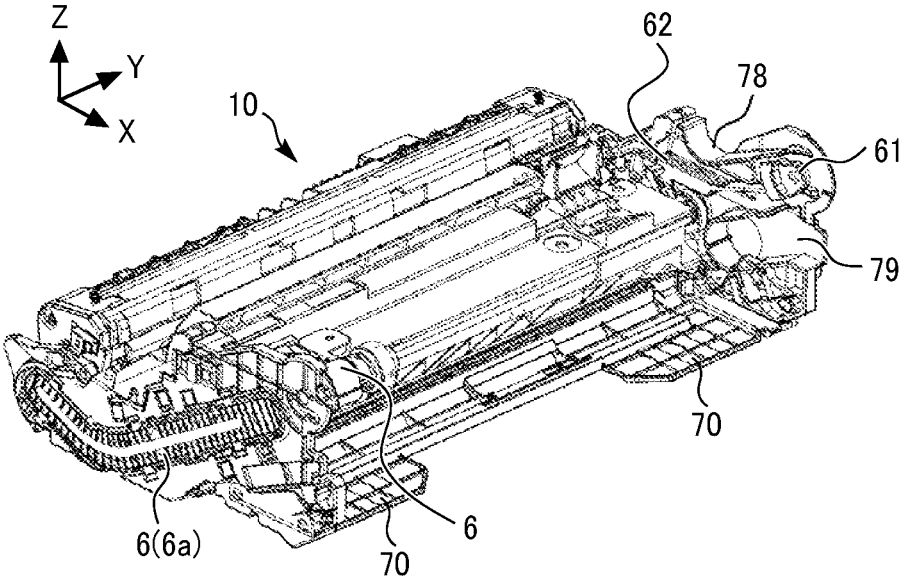
Figure 7:
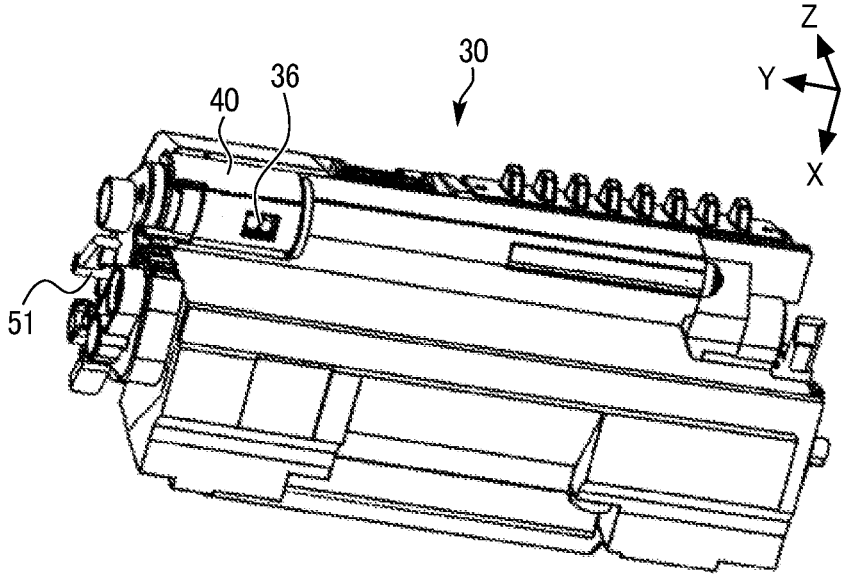
FIG. 7 is a perspective view of the toner container with a first container shutter (a discharge port) open when viewed from below.

Furthermore, as illustrated in FIG. 4, a single removable component (a united component formed of the toner container 30 and the process cartridge 10) in which the toner container 30 is attached to the process cartridge 10 is installable in and removable from the image forming apparatus 100. As illustrated in FIG. 5, the toner container 30 can be attached to the process cartridge 10 by moving the toner container 30 in a predetermined direction indicated by the white arrow in FIG. 5. On the other hand, the toner container 30 can be removed from the process cartridge 10 by moving the toner container 30 in a direction opposite to the predetermined direction. The toner container 30 alone as illustrated in FIG. 7 is distributed in the market. The process cartridge 10 alone as illustrated in FIGS. 6A and 6B is similarly distributed in the market.

When the toner container 30 is attached to or detached from the process cartridge 10 (or the image forming apparatus 100), an operator, such as a user, pulls out or pushes in the toner container 30, while gripping a handle 38 of the toner container 30. The handle 38 is attached to the front side of the toner container 30 in a direction of detachment operation (positive X-direction) as illustrated FIGS. 2 to 5. The handle 38 is foldable. When the cover 90 is closed in a state in which the toner container 30 is installed in the image forming apparatus 100 with the handle 38 standing up as illustrated in FIGS. 4 and 5, the handle 38 is pushed by the cover 90 in conjunction with a movement of the cover 90 from an open state to a closed state, thereby accommodating the handle 38 along an exterior of the toner container 30.

Figure 8:
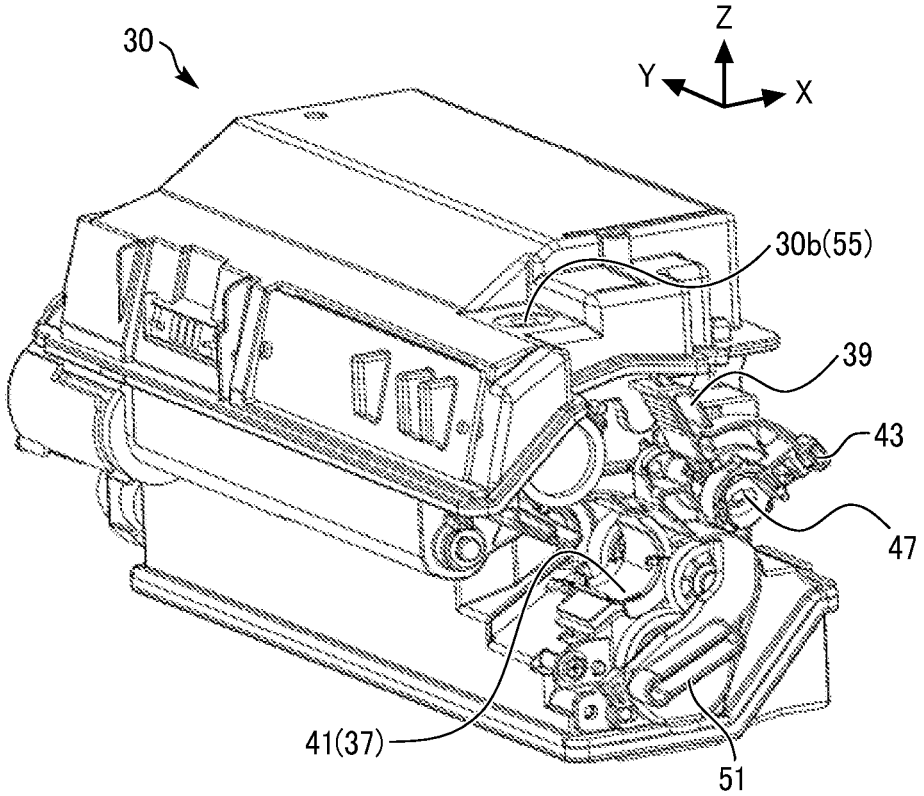
FIG. 8 is a perspective view of the toner container with a second container shutter (a collection port) closed when viewed from the collection port side.

The toner container 30 includes first and second positioning portions 49 and 50 illustrated in FIG. 5 and a guide 51 illustrated in FIGS. 7 and 8. The process cartridge 10 has multiple guide grooves 77 and 79 and a guide receiver 78 illustrated in FIG. 5. The first and second positioning portions 49 and 50 and the guide 51 engage with the guide receiver 78 and the multiple guide grooves 79 and 77, respectively. Thus, the toner container 30 can be attached to and detached from the process cartridge 10 and positioned in the process cartridge 10.

Specifically, the first and second positioning portions (positioning projections) 49 and 50 project from one end face of the toner container 30 in a width direction of the toner container 30 (positive Y-direction). The guide receiver 78 and the guide groove 79 are formed on one end face of the process cartridge 10 corresponding to the one end face of the toner container 30. The guide 51 projects from the other end face of the toner container 30 (negative Y-direction) and has a rectangular shape which is inclined upward in positive X-direction. The guide receiver 78 introduces the first positioning portion 49, the guide groove 79 introduces the second positioning portion 50, and the guide groove 77 formed at the other end face of the process cartridge 10 introduces the guide 51. Thus, the toner container 30 is attached to the process cartridge 10. The toner container 30 is positioned in the process cartridge 10 so that the first and second positioning portions 49 and 50 engage with dead ends of the guide receiver 78 and the guide groove 79, respectively, and the guide 51 engages with a dead end of the guide groove 77.

The first positioning portion 49 is a projection surrounding a coupling 33*c* (see FIG. 17) that transmits driving force from the image forming apparatus 100 to a first stirrer 33 (see FIGS. 2 and 9) to stir toner. The second positioning portion 50 is a projection surrounding a coupling gear to rotate a conveying screw 35 (see FIGS. 2 and 9). As described above, input portions to receive the driving force from the image forming apparatus 100 are disposed near (inside) the first and second positioning portions 49 and 50, enabling reliable driving force transmission.

Further, the process cartridge 10 includes a bottom plate 70, which is opposed to the bottom of the toner container 30 attached to the process cartridge 10, at a bottom portion of the process cartridge 10. The bottom plate 70 is disposed at each end portion of the process cartridge 10 in a width direction (i.e., a portion except a center portion of the process cartridge 10) and at the side of the process cartridge 10 to which the toner container 30 is attached. Such a configuration of the process cartridge 10 with the bottom plate 70 enables the toner container 30 to be firmly attached to the process cartridge 10 with unity.

The toner container (the powder container) 30 includes the discharge port 36, a collection port 37, a first container shutter 40 as a container shutter, and a second container shutter 41 as a container shutter.

With reference to FIGS. 2, 7, 9, and 16, the discharge port 36 of the toner container 30 is an opening for discharging toner (powder) stored in the toner container 30 (the toner storage 31) to the developing device 5. The discharge port 36 communicates with the inlet port 64 of the developing device 5 when the toner container 30 is attached to the process cartridge 10. The inlet port 64 is an opening disposed above the development conveying screw 5*c* as a conveying rotator.

With reference to FIGS. 2, 8, 10, and 13, the collection port 37 of the toner container 30 is an opening to receive waste toner (untransferred toner) as powder from the outside of the toner container 30 and to collect the waste toner in the toner container 30. The collection port 37 communicates with the outlet port 74 of the waste toner conveyor 6 when the toner container 30 is attached to the process cartridge 10. The outlet port 74 (see FIGS. 5 and 6) is an opening disposed on a bottom face of a downstream end of the waste toner conveyor 6 in a direction of conveyance of the waste toner.

Figure 9:
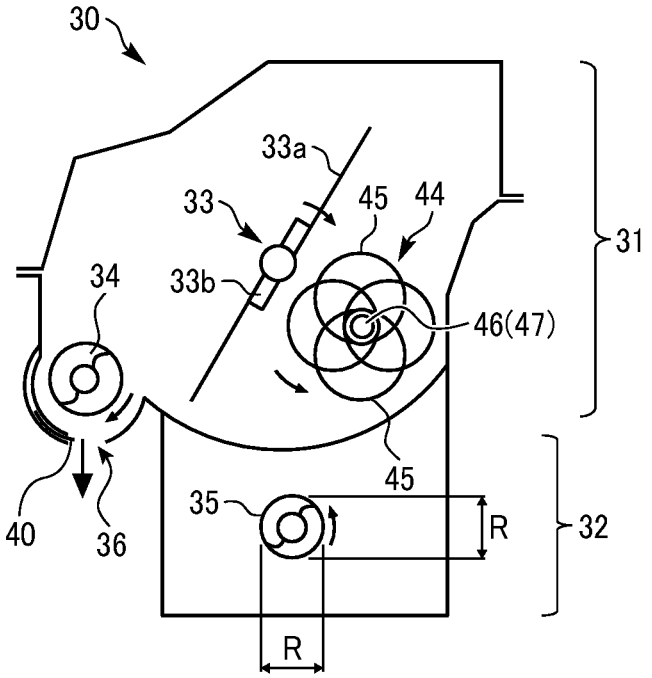
FIG. 9 is a schematic view of the inside of the toner container.
Figure 10:
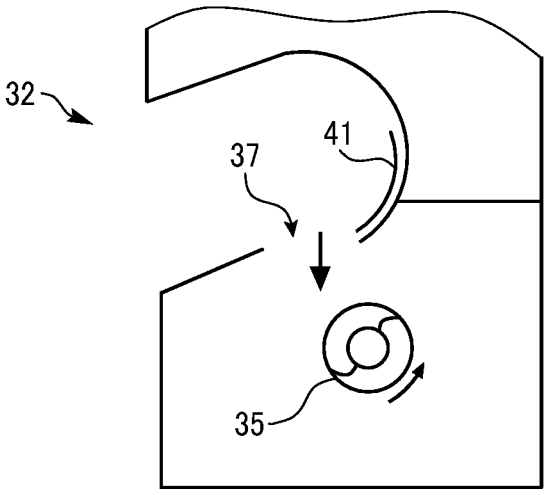
FIG. 10 is a schematic view illustrating a waste toner collection portion of the toner container.

In the toner container 30 according to the present embodiment, with reference to FIGS. 2, 9, and 10, the toner storage 31, as the powder storage, to store toner (powder) to be discharged from the discharge port 36 is separated from the waste toner collection portion 32 serving as the powder collection portion to collect the waste toner (powder) received from the collection port 37, by a wall.

As illustrated in FIG. 8, a ceiling surface of the toner container 30 (the toner storage 31) has an air vent hole 30*b* at an end in the width direction of the toner container 30, and a toner filter 55 covers the air vent hole 30*b*. The air vent hole 30*b* communicates with the inside of the toner storage 31. With such a configuration, the toner does not leak from the toner container 30 (the toner storage 31), and internal pressure of the toner container 30 (the toner storage 31) does not increase.

The toner storage (the powder storage) 31 further includes a supply screw 34 which rotates clockwise in FIGS. 2 and 9, the first stirrer (an agitator) 33 which rotates clockwise in FIGS. 2 and 9, and a second stirrer (a coil-shaped stirrer) 44. The second stirrer 44 is rotated counterclockwise in FIGS. 2 and 9 by contact with the first stirrer 33.

The supply screw 34 discharges a target amount of toner stored in the toner storage 31 from the discharge port 36 according to a drive timing and rotation duration controlled by a controller.

The first stirrer (the agitator) 33 rotates in a predetermined direction (clockwise direction in FIGS. 2 and 9 in the present embodiment) to stir the toner stored in the toner storage 31 to prevent the toner from agglomerating. As illustrated in FIG. 9, the first stirrer 33 includes a contact part (a rigid body) 33*b* and a flexible member 33*a*. The contact part 33*b* is plate-shaped and disposed across a rotation axis of the first stirrer 33, and the flexible member 33*a* is made of a plastic sheet and attached to the contact part 33*b* along the contact part 33*b*. Both ends of the first stirrer 33 in the axial direction thereof are rotatably supported by a housing of the toner container 30 through a pair of bearings, respectively.

Figure 17:
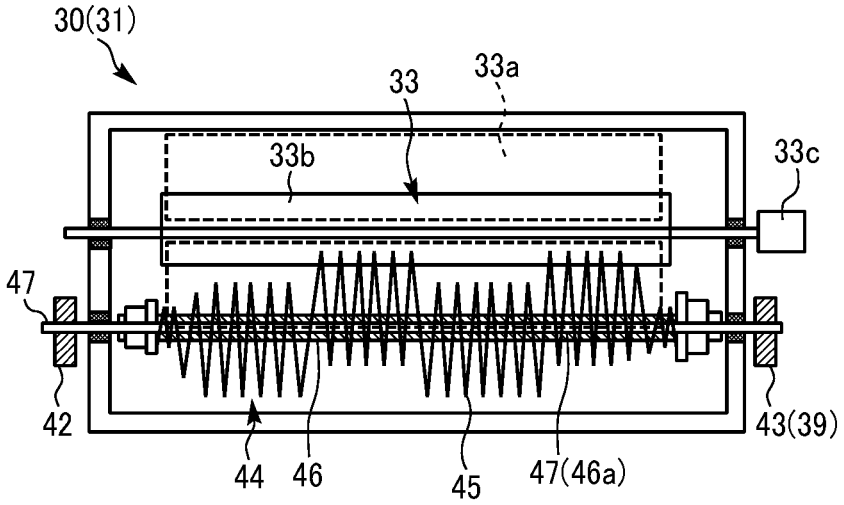
FIG. 17 is a schematic top view illustrating the inside of a toner storage of the toner container.

The second stirrer 44 stirs toner in a region of the toner storage 31 where stirring by the first stirrer 33 is not performed sufficiently. With reference to FIG. 17, the second stirrer (the coil-shaped stirrer) 44 includes a coil 45 including a plurality of divided coil portions, and a hollow member (a shaft) 46 to hold the coil 45. Coil centers of the plurality of divided coil portions are eccentric to a shaft center of the hollow member 46. A piercing shaft 47 as a shaft is inserted into the hollow member 46. The piercing shaft 47 is one component included in a mechanism to open and close the first container shutter 40 and the second container shutter 41 in conjunction with each other.

In the waste toner collection portion (the powder collection portion) 32, the conveying screw (a waste toner conveying screw) 35 as a conveying rotator which rotates counterclockwise in FIGS. 2, 9, and 10 is disposed. The conveying screw 35 conveys waste toner so that the waste toner that flows through the collection port 37 does not accumulate near (under) the collection port 37 and is evenly collected (distributed) in the waste toner collection portion 32.

In the present embodiment, as an operator rotates a lever 39 as an operation device in a state in which the toner container 30 is attached to the process cartridge 10 (or the image forming apparatus 100), the first container shutter 40 (the discharge port 36) and the second container shutter 41 (the collection port 37) simultaneously open and close. In addition to the first and second container shutters 40 and 41, the inlet port 64 and the outlet port 74 of the process cartridge 10 also simultaneously open and close. Therefore, open and close failures of the first and second container shutters 40 and 41 and first and second cartridge shutters 63 and 73 as cartridge shutters are prevented.

When the cover 90 opens in a state in which the toner container 30 is installed in the image forming apparatus 100, the lever (the operation device) 39 is exposed as illustrated in FIG. 3B so that the operator can operate the lever 39.

Figure 12A:
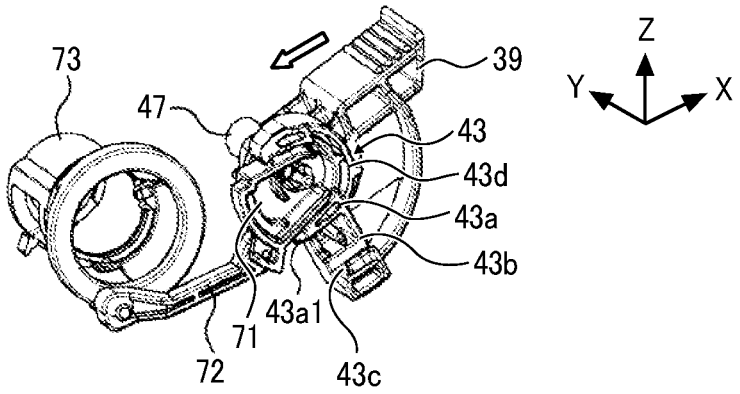
FIGS. 12A and 12B are perspective views illustrating a movement of a second cartridge shutter that opens and closes in the process cartridge.
Figure 12B:
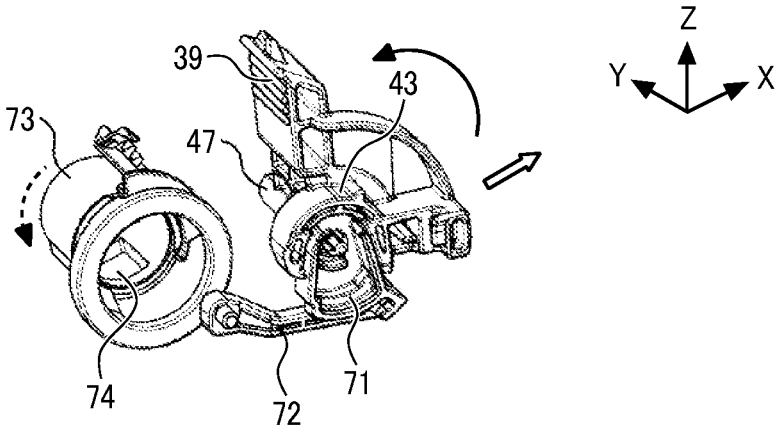
Figure 13A:
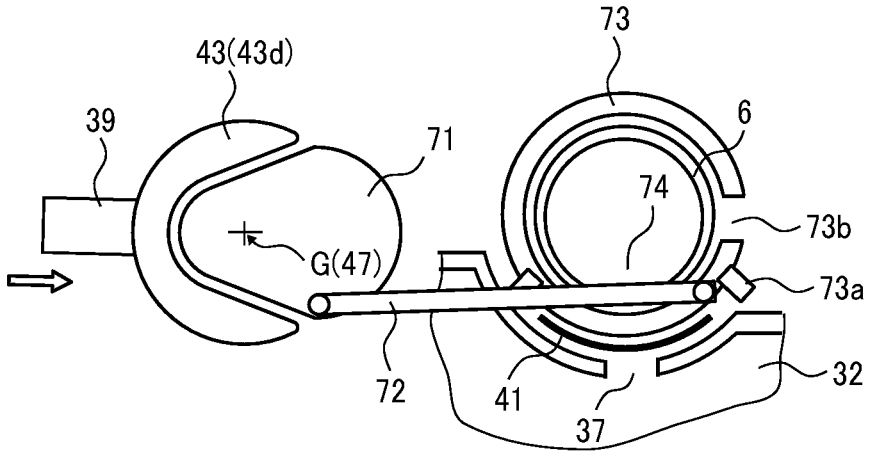
FIGS. 13A and 13B are schematic views illustrating movements of the second container shutter and the second cartridge shutter that open and close.
Figure 13B:
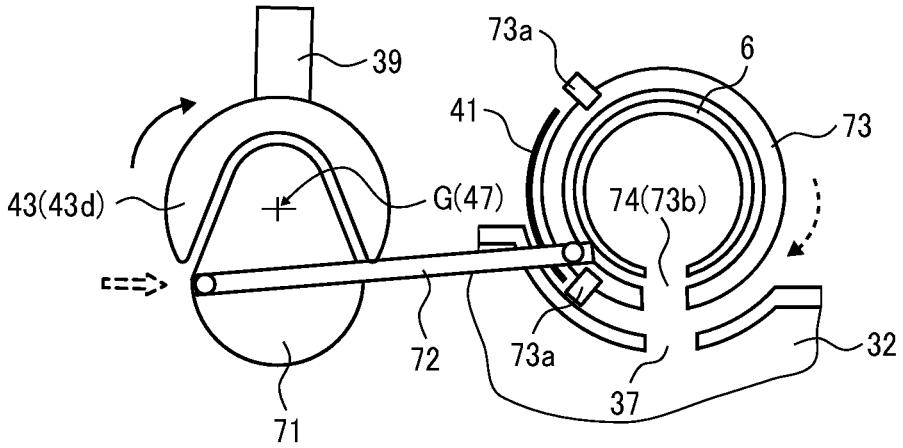

Specifically, as illustrated in FIGS. 8, 12, and 13, the toner container 30 further includes the lever 39 and a second rotation portion 43 as a rotation portion formed together with the lever 39 as a single unit which rotate along with the lever 39. The second rotation portion 43 is engageable with a second engagement portion 71 as an engagement portion (see FIGS. 11 to 13B and 19A to 19C). The second engagement portion 71 is approximately arc-shaped and included in the process cartridge 10. The second engagement portion 71 is rotatable. As the second engagement portion 71 rotates, the second cartridge shutter 73 as the cartridge shutter opens and closes.

The second rotation portion 43 is shaped as a circle in which a part of the circle is missing in an arc shape. Specifically, the second rotation portion 43 includes a circular portion 43*d* which engages with the second engagement portion 71, a protrusion 43*b* projecting from the circular portion 43*d*, and a second contact portion 43*a* as a contact portion. The second contact portion 43*a* contacts a second projection 75 (see FIG. 11) to be described later, thereby canceling restriction of rotation of the second engagement portion 71. The protrusion 43*b* has a recess 43*c* to sandwich a second plate casing 76 as a plate casing (see FIG. 11) as described later.

The second contact portion 43*a* is a part of the second rotation portion 43 near an edge of the missing portion in the arc shape and includes an inclined surface (a tapered portion) 43*a*1 whose height (a thickness) gradually decreases toward a tip of the second contact portion 43*a* along a direction in which the toner container 30 is attached to the process cartridge 10. In conjunction with attachment of the toner container 30 to the process cartridge 10, the second projection 75 is smoothly pressed while the inclined surface 43*a*1 of the second contact portion 43*a* slides on an inclined surface (a tapered portion) 75*a* of the second projection 75, thereby canceling the restriction of rotation of the second engagement portion 71.

Figure 11:
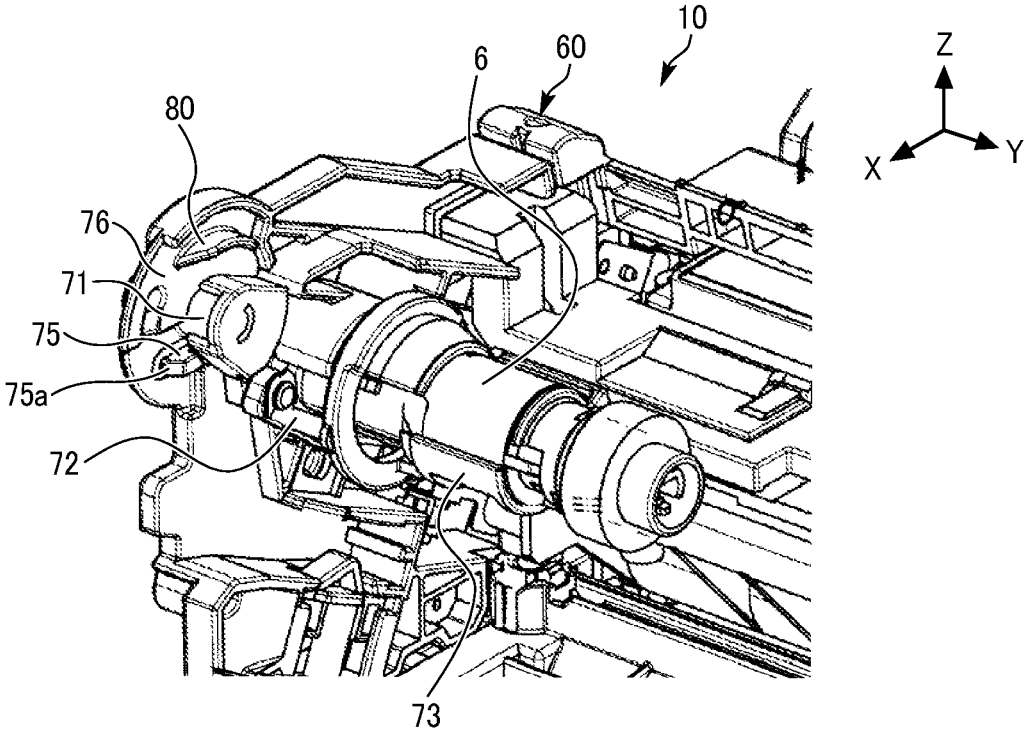
FIG. 11 is an enlarged perspective view illustrating a second engagement portion of the process cartridge and the vicinity thereof.

When the toner container 30 is attached to the process cartridge 10, the second rotation portion 43 is moved along a guide 80 (see FIG. 11). Thus, as illustrated in FIGS. 12A and 13A, the second rotation portion 43 of the toner container 30 sandwiches the second engagement portion 71 of the process cartridge 10 and engages with the second engagement portion 71 of the process cartridge 10. At that time, the second engagement portion 71 enters inside the second rotation portion 43. As illustrated in FIGS. 12B and 13B, as the lever 39 rotates in a state in which the second engagement portion 71 of the process cartridge 10 engages with the second rotation portion 43 of the toner container 30, the second rotation portion 43 of the toner container 30 rotates along with the second engagement portion 71, thereby completing engagement of the process cartridge 10 and the toner container 30. Accordingly, the toner container 30 does not move in a direction of being pulled out from the process cartridge 10.

The second rotation portion 43 is rotated along with the second engagement portion 71 by an operation of the lever 39 from states in FIGS. 12A and 13A to states in FIGS. 12B and 13B. As the second rotation portion 43 and the second engagement portion 71 rotate, a second link 72 coupled to the second engagement portion 71 of the process cartridge 10 moves in conjunction with the second engagement portion 71 in a direction to open the second cartridge shutter 73 of the process cartridge 10, thereby opening the outlet port 74. Further, a pushing portion 73*a* (see FIGS. 13A and 13B) of the second cartridge shutter 73 that moves in the direction to open the second cartridge shutter 73 pushes the second container shutter 41 in a direction to open the second container shutter 41 of the toner container 30, thereby opening the collection port 37. As a result, the outlet port 74 of the process cartridge 10 communicates with the collection port 37 of the toner container 30 via an opening 73*b* (see FIGS. 13A and 13B) of the second cartridge shutter 73.

Thus, waste toner can be delivered from the process cartridge 10 to the toner container 30 (the waste toner collection portion 32).

When the toner container 30 is detached from the process cartridge 10, the second rotation portion 43 rotates in a reverse direction opposite to the above-described direction along with a reverse rotation of the lever 39, and the second link 72 moves in conjunction with the rotation of the second rotation portion 43. As the second link 72 moves, the second cartridge shutter 73 (the outlet port 74) closes, and the pushing portion 73*a* of the second cartridge shutter 73 pushes the second container shutter 41, thereby closing the second container shutter 41 (the collection port 37). As a result, the second rotation portion 43 of the toner container 30 disengages from the second engagement portion 71 of the process cartridge 10.

In the present embodiment, the pushing portion 73*a* of the second cartridge shutter 73 pushes the second container shutter 41, thereby closing the second container shutter 41 (the collection port 37). Alternatively, a biasing member such as a compression spring can be provided to bias the second container shutter 41 in a direction to close the second container shutter 41. In this case, when the toner container 30 is detached from the process cartridge 10, the second rotation portion 43 rotates in the reverse direction opposite to the above-described direction along with the reverse rotation of the lever 39, and the second link 72 moves in conjunction with the second rotation portion 43, thereby closing the second cartridge shutter 73 (the outlet port 74). Further, the second container shutter 41 (the collection port 37) is closed by pressing force of the biasing member. Accordingly, when the second container shutter 41 (the collection port 37) is opened, the pushing portion 73*a* of the second cartridge shutter 73 pushes the second container shutter 41 against the pressing force of the biasing member.

As illustrated in FIGS. 5 and 15A to 18, the toner container 30 further includes a first rotation portion 42 as a rotation portion disposed opposite the lever 39 (and the second rotation portion 43) in the width direction of the toner container 30. The first rotation portion 42 is coupled to the second rotation portion 43 via the piercing shaft (the shaft) 47 and rotates along with the lever 39 (the second rotation portion 43, and the piercing shaft 47). The first rotation portion 42 is engageable with a first engagement portion 61 as an engagement portion (see FIGS. 14 to 16B). The first engagement portion 61 is approximately arc-shaped and included in the process cartridge 10. The first engagement portion 61 is rotatable. As the first engagement portion 61 rotates, the first cartridge shutter 63 as the cartridge shutter opens and closes.

The first rotation portion 42 is shaped as a circle in which a part of circle is missing in an arc shape. Specifically, the first rotation portion 42 includes a circular portion 42*d* which engages with the first engagement portion 61, the protrusion 42*b* projecting from the circular portion 42*d*, and a first contact portion 42*a* as a contact portion. The first contact portion 42*a* contacts a first projection 65 (see FIG. 14) to be described later, thereby canceling restriction of rotation of the first engagement portion 61. The protrusion 42*b* has a recess 42*c* to sandwich a first plate casing 66 as a plate casing (see FIG. 14) as described later.

The first contact portion 42*a* is a part of the first rotation portion 42 near an edge of the missing portion in the arc shape and includes an inclined surface (a tapered portion) 42*a*1 whose height (a wall thickness) gradually decreases toward a tip of the first contact portion 42*a* along the direction in which the toner container 30 is attached to the process cartridge 10. In conjunction with the attachment of the toner container 30 to the process cartridge 10, the first projection 65 is smoothly pressed while the inclined surface 42*a*1 of the first contact portion 42*a* slides on an inclined surface (a tapered portion) 65*a* of the first projection 65, thereby canceling the restriction of rotation of the first engagement portion 61.

Figure 14:
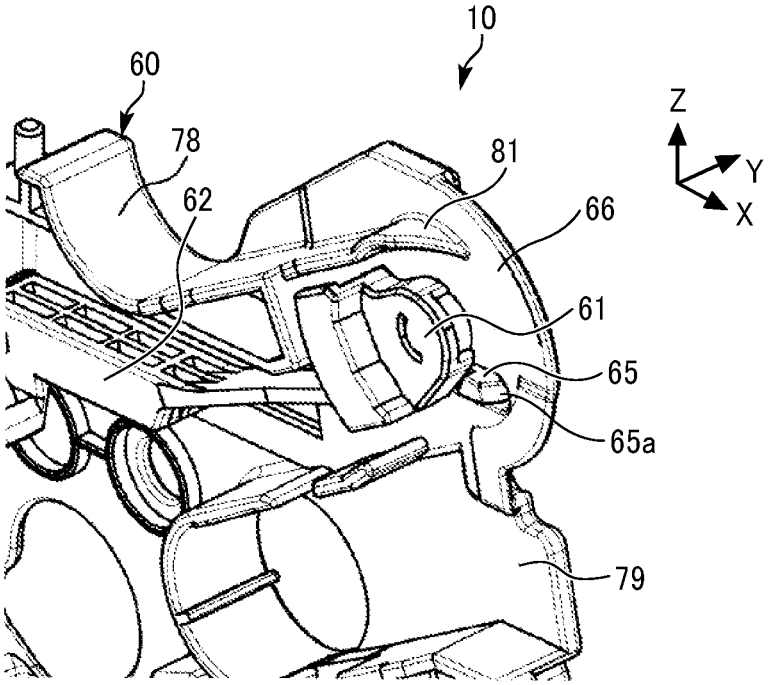
FIG. 14 is an enlarged perspective view illustrating a first engagement portion of the process cartridge and the vicinity thereof.
Figure 15A:
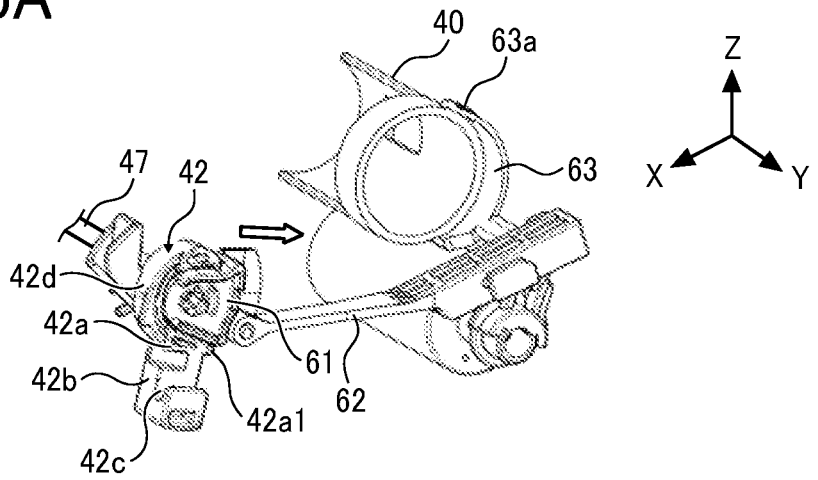
FIGS. 15A and 15B are perspective views illustrating a movement of a first cartridge shutter that opens and closes in the process cartridge.
Figure 15B:
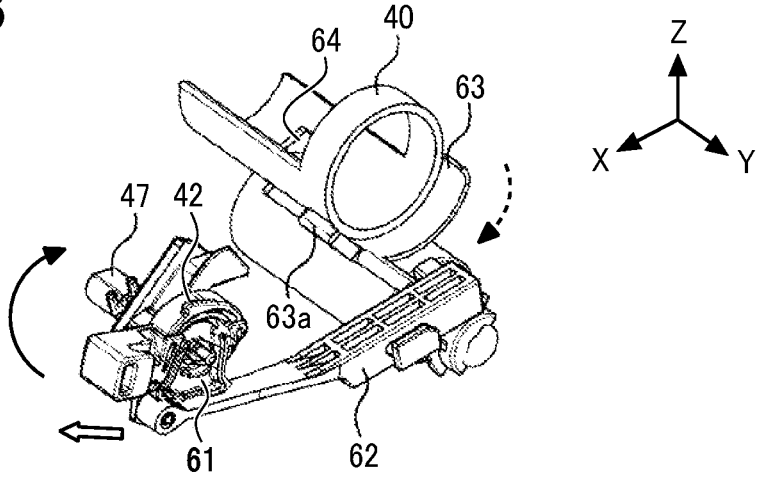
Figure 16A:
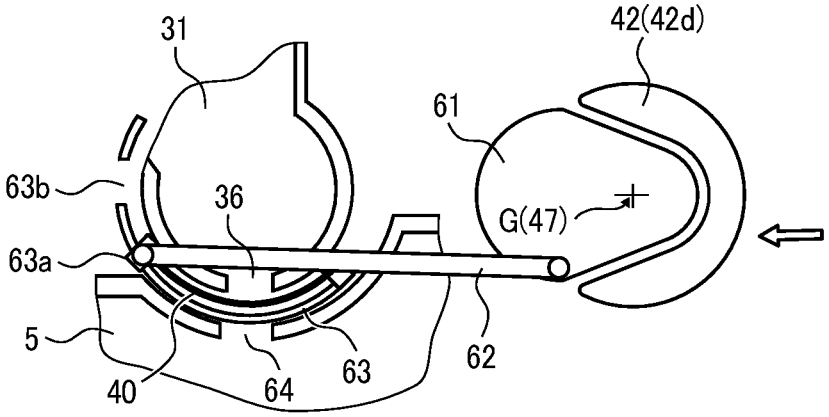
FIGS. 16A and 16B are schematic views illustrating movements of the first container shutter and the first cartridge shutter that open and close.
Figure 16B:
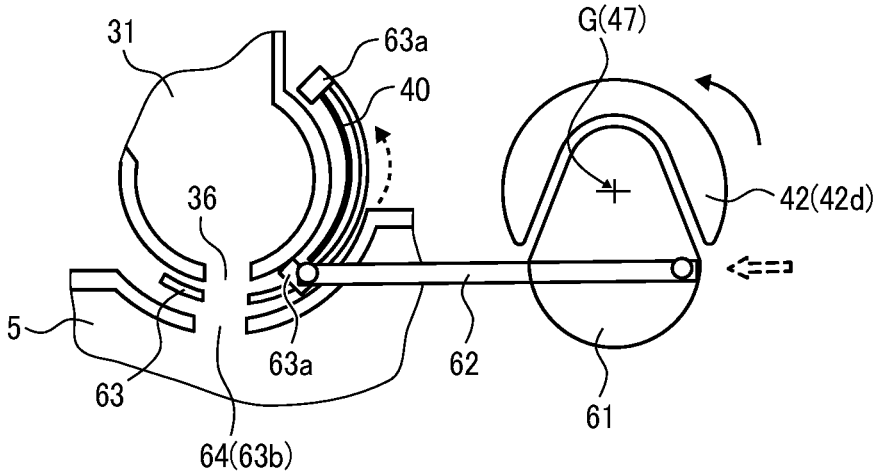

When the toner container 30 is attached to the process cartridge 10, the first rotation portion 42 is moved along a guide 81 (see FIG. 14). Thus, as illustrated in FIGS. 15A and 16A, the first rotation portion 42 of the toner container 30 sandwiches the first engagement portion 61 of the process cartridge 10 and engages with the first engagement portion 61 of the process cartridge 10. At that time, the first engagement portion 61 enters inside the first rotation portion 42. As illustrated in FIGS. 15B and 16B, as the lever 39 (and the second rotation portion 43) rotates in a state in which the first engagement portion 61 of the process cartridge 10 engages with the first rotation portion 42 of the toner container 30, the first rotation portion 42 rotates along with the first engagement portion 61 via the piercing shaft 47, thereby completing the engagement of the process cartridge 10 and the toner container 30. Accordingly, the toner container 30 does not move in the direction of being pulled out from the process cartridge 10.

The first rotation portion 42 is rotated along with the first engagement portion 61 by the operation of the lever 39 from states in FIGS. 15A and 16A to states in FIGS. 15B and 16B. As the first rotation portion 42 and the first engagement portion 61 rotate, a first link 62 coupled to the first engagement portion 61 of the process cartridge 10 moves in conjunction with the first engagement portion 61 in a direction to open the first cartridge shutter 63 of the process cartridge 10, thereby opening the inlet port 64. Further, a pushing portion 63*a* of the first cartridge shutter 63 that moves in the direction to open the first cartridge shutter 63 pushes the first container shutter 40 in a direction to open the first container shutter 40 of the toner container 30, thereby opening the discharge port 36. As a result, the inlet port 64 of the process cartridge 10 communicates with the discharge port 36 of the toner container 30 via an opening 63*b* of the second cartridge shutter 63 (see FIG. 16B). Thus, fresh toner can be delivered from the toner container 30 (the toner storage 31) to the process cartridge 10 (the developing device 5).

When the toner container 30 is detached from the process cartridge 10, the first rotation portion 42 rotates in the reverse direction opposite to the above-described direction along with the reverse rotation of the lever 39, and the first link 62 moves in conjunction with the first rotation portion 42. As the first link 62 moves, the first cartridge shutter 63 (the inlet port 64) closes, and the pushing portion 63*a* of the first cartridge shutter 63 pushes the first container shutter 40, thereby closing the first container shutter 40 (the discharge port 36). As a result, the first rotation portion 42 of the toner container 30 disengages from the first engagement portion 61 of the process cartridge 10.

In the present embodiment, the pushing portion 63*a* of the first cartridge shutter 63 pushes the first container shutter 40, thereby closing the first container shutter 40 (the discharge port 36). Alternatively, similarly to the second container shutter 41 described above, a biasing member such as a compression spring can be provided to bias the first container shutter 40 in a direction to close the first container shutter 40.

In the present embodiment, if the toner container 30 is installed in the image forming apparatus 100 in a state in which the lever 39 falls as illustrated in FIG. 5, the lever 39 is pushed by a pushing member 91 (see FIG. 3B) of the cover 90 in conjunction with the movement of the cover 90 from the open state to the closed state, simultaneously causing the first container shutter 40 to open the discharge port 36, the first cartridge shutter 63 to open the inlet port 64, the second container shutter 41 to open the collection port 37, and the second cartridge shutter 73 to open the outlet port 74. Therefore, a set failure of the toner container 30 can be prevented.

The pushing member 91 is not fixed to the cover 90 in a standing state as illustrated in FIG. 3B. The pushing member 91 is foldable and switchable between the standing state and a falling state. The pushing member 91 is in the falling state at the factory shipment. When the pushing member 91 is in the falling state, the lever 39 in the falling state as illustrated in FIG. 4 is not pushed by the pushing member 91 in the closed state of the cover 90. Accordingly, the discharge port 36 and the collection port 37 remain closed. The image forming apparatus 100 is shipped from a factory in a state in which the toner container 30 is installed in the image forming apparatus 100 with the discharge port 36 and the collection port 37 closed by the first and second container shutters 40 and 41. Therefore, it is unnecessary to pack and ship the image forming apparatus 100 and the toner container 30 separately, and toner does not leak out of the toner container 30 installed in the image forming apparatus 100 due to vibration during transport.

After arrival of the image forming apparatus 100 to a user, the user (or a service person) rotates the pushing member 91 from the falling state to the standing state. This operation to rotate the pushing member 91 to the standing state is performed in a state in which the cover 90 is open (and the first and second container shutters 40 and 41 remain closed). As the user (or the service person) only closes the cover 90 after erecting the pushing member 91, the first and second container shutters 40 and 41 open. As a result, toner is supplied from the toner container 30 to the empty developing device 5, and the developing device 5 becomes available for use.

A distinctive configuration and an operation of the toner container 30 as the powder container according to the present embodiment are described below.

As described above with reference to FIGS. 11 to 17, the toner container (the powder container) 30 according to the present embodiment includes the collection port 37 to receive and collect toner from outside of the toner container 30, the second container shutter 41 as the container shutter to open and close the collection port 37, and the second rotation portion 43 which rotates in conjunction with the operation of the lever (the operation device) 39.

The toner container 30 further includes the discharge port 36 to discharge toner (powder) stored in the toner container 30, the first container shutter 40 as the container shutter to open and close the discharge port 36, and the first rotation portion 42 as the rotation portion. The first rotation portion 42 is coupled to the second rotation portion 43 via the piercing shaft 47 and rotates along with the second rotation portion 43 in conjunction with the operation of the lever (the operation device) 39.

In the present embodiment, the piercing shaft 47 is inserted into the hollow part 46*a* of the hollow member 46 included in the second stirrer 44 as illustrated in FIG. 17. The piercing shaft 47 and the second stirrer 44 (the hollow member 46) rotate independently of each other.

Specifically, the shaft cross-section of the piercing shaft 47 is circular, and the hole cross-section of the hollow part 46*a* of the hollow member 46 is circular. The hole cross-section has a slightly larger diameter than the shaft cross-section. With such a configuration, irrespective of the rotation of the second stirrer 44 to stir toner in the toner storage 31, the piercing shaft 47 can be rotated by the lever 39 manually operated, thereby rotating the first and second rotation portions 42 and 43 (the first and second container shutters 40 and 41, and the first and second cartridge shutters 63 and 73) in conjunction with each other.

In the present embodiment, the lever 39 as the operation device is formed together with the second rotation portion 43 as a single unit. Alternatively, the lever 39 can be formed together with the first rotation portion (the rotation portion) 42 as a single unit.

The process cartridge (the removable component) 10 includes the inlet port 64, the outlet port 74, the first cartridge shutter 63, the second cartridge shutter 73, the first engagement portion 61, the second engagement portion 71, the first projection (a first restriction member) 65 as a restriction member, and the second projection (a second restriction member) 75 as a restriction member.

The inlet port 64 of the process cartridge 10 can communicate with the discharge port 36 of the toner container 30 when the toner container 30 is attached to the process cartridge 10.

The outlet port 74 of the process cartridge 10 can communicate with the collection port 37 of the toner container 30 when the toner container 30 is attached to the process cartridge 10.

The first cartridge shutter 63 of the process cartridge 10 opens and closes the inlet port 64. In the state in which the toner container 30 is attached to the process cartridge 10, as the first cartridge shutter 63 opens (or closes) the inlet port 64, the first cartridge shutter 63 pushes the first container shutter 40 to open (or close) the discharge port 36 of the toner container 30.

The second cartridge shutter 73 of the process cartridge 10 opens and closes the outlet port 74. In the state in which the toner container 30 is attached to the process cartridge 10, as the second cartridge shutter 73 opens (or closes) the outlet port 74, the second cartridge shutter 73 pushes the second container shutter 41 to open (or close) the collection port 37 of the toner container 30.

The first engagement portion 61 of the process cartridge 10 is rotatable around a support axis G that is a rotation axis of the first engagement portion 61, and approximately coincides with the shaft center of the piercing shaft 47 (see FIG. 16). The first engagement portion 61 is engageable with the first rotation portion 42.

The second engagement portion 71 of the process cartridge 10 is rotatable around the support axis G that is the rotation axis of the second engagement portion 71, and approximately coincides with the shaft center of the piercing shaft 47 (see FIG. 13). The second engagement portion 71 is engageable with the second rotation portion 43.

The process cartridge 10 according to the present embodiment includes the first projection 65 as the restriction member to restrict the rotation of the first engagement portion 61 as illustrated in FIGS. 14 and 19A to 19C.

Figure 19A:
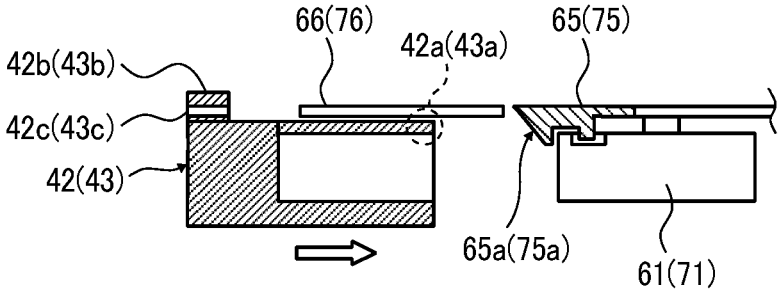
FIGS. 19A to 19C are schematic views illustrating a movement in which the first rotation portion (the second rotation portion) engages with the first engagement portion (the second engagement portion)

The first engagement portion 61 is rotatably supported by the first plate casing 66 that is a part of a housing (a side plate) 60 of the process cartridge 10. The first projection 65 is disposed in the first plate casing 66 and projects toward the inside of the process cartridge 10 from the first plate casing 66. The first projection 65 is elastically deformable around the root of the first projection 65. As illustrated in FIGS. 14 and 19A, the first projection 65 engages with the first engagement portion 61, thereby preventing the first engagement portion 61 from rotating.

The first rotation portion 42 includes the first contact portion 42*a* that contacts the first projection (the first restriction member) 65 in conjunction with the attachment of the toner container 30 to the process cartridge 10, in order to cancel the restriction of rotation of the first engagement portion 61.

As the first rotation portion 42 engaging with the first engagement portion 61 rotates the first engagement portion 61 in conjunction with the operation of the lever (the operation device) 39, the first cartridge shutter 63 and the first container shutter 40 are moved, and the inlet port 64 and the discharge port 36 are thereby opened.

Figure 18:
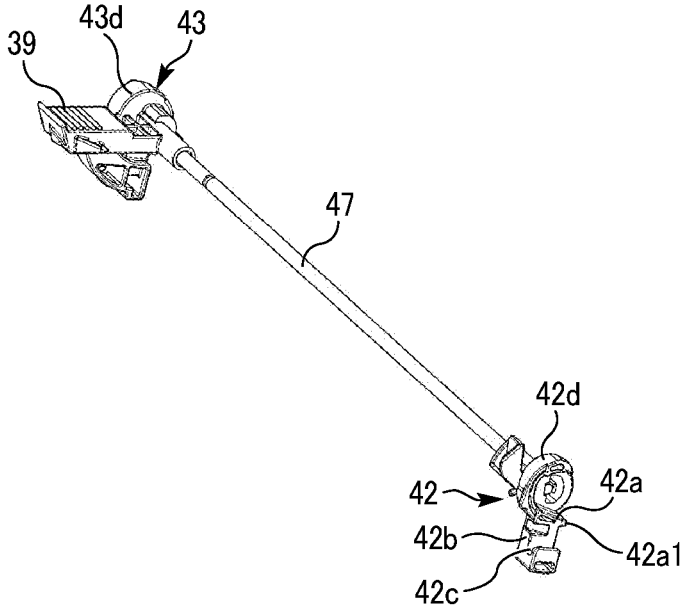
FIG. 18 is a perspective view illustrating a piercing shaft, a first rotation portion, and a second rotation portion of the toner container.
Figure 19B:
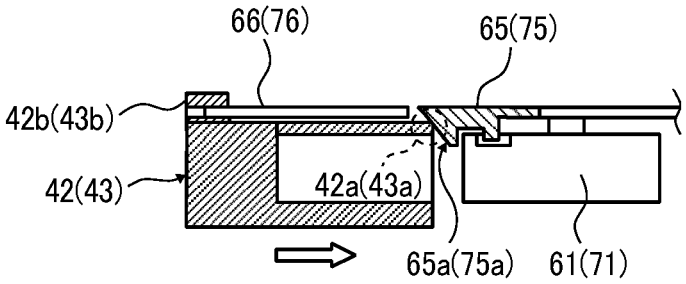
Figure 19C:
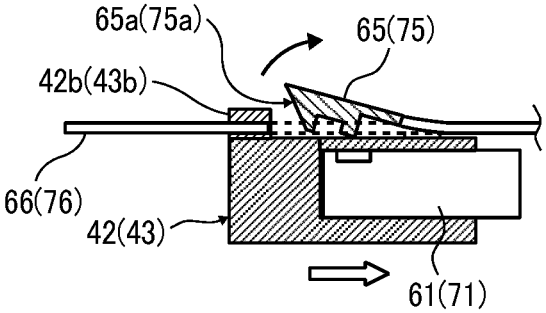

That is, as illustrated in FIGS. 19A to 19C, the first contact portion 42*a* of the first rotation portion 42 pushes the first projection (the first restriction member) 65 in conjunction with the attachment of the toner container 30 to the process cartridge 10, thereby canceling the restriction of rotation of the first engagement portion 61. The first contact portion 42*a* is approximately V-shaped as illustrated in FIG. 18.

Specifically, as illustrated in FIG. 19A, when the toner container 30 is not attached to the process cartridge 10, the first projection 65 engages with the first engagement portion 61 to prevent the first engagement portion 61 from rotating. In conjunction with the attachment of the toner container 30 to the process cartridge 10, as the first rotation portion 42 moves toward the first engagement portion 61 as indicated by the white arrow in FIG. 19A, the first contact portion 42*a* of the first rotation portion 42 contacts the tapered portion of the first projection 65 as illustrated in FIG. 19B. The tapered portion has the inclined surface 65*a* inclined from left to right, facing downward as illustrated in FIGS. 19A to 19C. As the first rotation portion 42 moves further, force acting against the tapered portion elastically deforms the first projection 65, thereby canceling the restriction of rotation of the first engagement portion 61. The first rotation portion 42 smoothly moves along the inclined surface 65*a* of the tapered portion in a direction indicated by the white arrow in FIG. 19C while elastically deforming the first projection 65.

Thus, the first rotation portion 42 engages with the first engagement portion 61 as illustrated in FIG. 19C (and FIGS. 15A and 16A). Accordingly, the first engagement portion 61 is brought in a rotatable state together with the first rotation portion 42. At that time, the first projection 65 is pushed by the first rotation portion 42 and maintains the elastically deformed state as illustrated in FIG. 19C.

As illustrated in FIGS. 16A and 16B, in a state in which the first rotation portion 42 engages with the first engagement portion 61, the first engagement portion 61 rotates along with the first rotation portion 42 in conjunction with the operation of the lever (the operation device) 39. As a result, the first cartridge shutter 63 moves in conjunction with the rotation of the first engagement portion 61, thereby opening the inlet port 64 and the discharge port 36.

When the toner container 30 is detached from the process cartridge 10, the above-described processes are performed in reverse, and the first projection 65 prevents the first engagement portion 61 from rotating.

In the present embodiment, if an operator touches the first engagement portion 61 of the process cartridge 10 to which the toner container 30 is not attached, since the first projection 65 prevents the first engagement portion 61 from rotating, the first cartridge shutter 63 is not erroneously opened. As a result, an inconvenience that toner leaks from the inlet port 64 of the process cartridge 10 to the outside, or foreign substances enter the inside of the process cartridge 10 through the inlet port 64 is not likely to occur.

In the present embodiment, as illustrated in FIGS. 15A and 18, the protrusion 42*b* projects from the circular portion 42*d* of the first rotation portion 42 in the radial direction of the circular portion 42*d*. The protrusion 42*b* has the recess 42*c* that opens toward the center in the radial direction of the circular portion 42*d*, on the tip side of the protrusion 42*b*. As illustrated in FIGS. 19A to 19C, in conjunction with the attachment of the toner container 30 to the process cartridge 10, the first rotation portion 42 pushes the first projection 65 in a state in which the recess 42*c* of the protrusion 42*b* of the first rotation portion 42 sandwiches the first plate casing 66 (see FIG. 14), thereby canceling the restriction of rotation of the first engagement portion 61.

The first contact portion 42*a* pushes and deforms the first projection 65 in a state in which the first rotation portion 42 sandwiches the first plate casing 66 so as not to deform the first plate casing 66. Therefore, the first projection 65 is reliably deformed relative to the first plate casing 66, thereby reliably canceling the restriction of rotation of the first engagement portion 61. That is, when the first projection 65 is elastically deformed by pushing of the first rotation portion 42, if the first plate casing 66 is bent in the same direction along with the deformation of the first projection 65, the first projection 65 is hardly deformed relative to the first plate casing 66. Therefore, the first projection 65 may not sufficiently cancel the restriction of rotation of the first engagement portion 61. On the other hand, in the present embodiment, since the deformation of the first plate casing 66 is minimized, the above-described inconvenience is unlikely to occur.

The process cartridge 10 according to the present embodiment includes the second projection 75 as the restriction member to restrict the rotation of the second engagement portion 71 as illustrated in FIGS. 11 and 19A to 19C.

The second engagement portion 71 is rotatably supported by the second plate casing 76 that is a part of the housing (the side plate) 60 of the process cartridge 10. The second projection 75 is disposed in the second plate casing 76 and projects toward the inside of the process cartridge 10 from the second plate casing 76. The second projection 75 is elastically deformable around the root of the second projection 75. As illustrated in FIGS. 11 and 19A, the second projection 75 engages with the second engagement portion 71, thereby preventing the second engagement portion 71 from rotating.

The second rotation portion 43 includes the second contact portion 43*a* that contacts the second projection (the second restriction member) 75 in conjunction with the attachment of the toner container 30 to the process cartridge 10, in order to cancel the restriction of rotation of the second engagement portion 71.

As the second rotation portion 43 engaging with the second engagement portion 71 rotates the second engagement portion 71 in conjunction with the operation of the lever 39, the second cartridge shutter 73 and the second container shutter 41 are moved, and the outlet port 74 and the collection port 37 are thereby opened.

That is, as illustrated in FIGS. 19A to 19C, the second contact portion 43*a* of the second rotation portion 43 pushes the second projection (the second restriction member) 75 in conjunction with the attachment of the toner container 30 to the process cartridge 10, thereby canceling the restriction of rotation of the second engagement portion 71. At that time, the second projection 75 operates similarly to the first projection 65 described above.

Thus, the second rotation portion 43 engages with the second engagement portion 71 as illustrated in FIG. 19C (and FIGS. 12A and 13A). Accordingly, the second engagement portion 71 is brought in a rotatable state together with the second rotation portion 43. At that time, the second projection 75 is pushed by the second rotation portion 43 and maintains the elastically deformed state as illustrated in FIG. 19C.

As illustrated in FIGS. 13A and 13B, in a state in which the second rotation portion 43 engages with the second engagement portion 71, the second engagement portion 71 rotates along with the second rotation portion 43 in conjunction with the operation of the lever (the operation device) 39. As a result, the second cartridge shutter 73 moves in conjunction with the rotation of the second engagement portion 71, thereby opening the outlet port 74 and the collection port 37.

When the toner container 30 is detached from the process cartridge 10, the above-described processes are performed in reverse, and the second projection 75 prevents the second engagement portion 71 from rotating.

In the present embodiment, if an operator touches the second engagement portion 71 of the process cartridge 10 to which the toner container 30 is not attached, since the second projection 75 prevents the second engagement portion 71 from rotating, the second cartridge shutter 73 is not erroneously opened. As a result, an inconvenience that waste toner leaks from the outlet port 74 of the process cartridge 10 to the outside is not likely to occur.

In the present embodiment, as illustrated in FIG. 12A, the protrusion 43*b* projects from the circular portion 43*d* of the second rotation portion 43 in the radial direction of the circular portion 43*d*. The protrusion 43*b* has the recess 43*c* that opens toward the center in the radial direction of the circular portion 43*d*, on the tip side of the protrusion 43*b*. As illustrated in FIGS. 19A to 19C, in conjunction with the attachment of the toner container 30 to the process cartridge 10, the second rotation portion 43 pushes the second projection 75 in a state in which the recess 43*c* of the protrusion 43*b* of the second rotation portion 43 sandwiches the second plate casing 76 (see FIG. 11), thereby canceling the restriction of rotation of the second engagement portion 71.

Thus, since the second contact portion 43*a* pushes and deforms the second projection 75 in a state in which the second rotation portion 43 sandwiches the second plate casing 76 so as not to deform the second plate casing 76. Therefore, the second projection 75 is reliably deformed relative to the second plate casing 76, thereby reliably canceling the restriction of rotation of the second engagement portion 71. That is, when the second projection 75 is elastically deformed by pushing of the second rotation portion 43, if the second plate casing 76 is bent in the same direction along with the deformation of the second projection 75, the second projection 75 is hardly deformed relative to the second plate casing 76. Therefore, the second projection 75 may not sufficiently cancel the restriction of rotation of the second engagement portion 71. On the other hand, in the present embodiment, since the deformation of the second plate casing 76 is minimized, the above-described inconvenience is unlikely to occur.

As illustrated in FIG. 16B, in the present embodiment, the first engagement portion 61 rotates along with the first rotation portion 42 in a state in which the first rotation portion 42 engages with the first engagement portion 61, thereby opening the inlet port 64 and the discharge port 36. At that time, a direction in which the first rotation portion 42 engages with the first engagement portion 61 (i.e., the vertical direction in FIG. 16B) is approximately perpendicular to a direction in which the toner container 30 is attached to and detached from the process cartridge 10 (i.e., the left and right direction indicated by the dashed white arrow in FIG. 16B).

With such a configuration, if force to detach the toner container 30 from the process cartridge 10 acts on the toner container 30, force to rotate the first engagement portion 61 along with the first rotation portion 42 clockwise in FIG. 16B is unlikely to act. Accordingly, it is difficult to detach the toner container 30 from the process cartridge 10. Therefore, such a configuration minimizes an inconvenience that the toner container 30 attached to the process cartridge 10 is erroneously detached from the process cartridge 10.

As illustrated in FIG. 13B, in the present embodiment, the second engagement portion 71 rotates along with the second rotation portion 43 in a state in which the second rotation portion 43 engages with the second engagement portion 71, thereby opening the outlet port 74 and the collection port 37. At that time, a direction in which the second rotation portion 43 engages with the second engagement portion 71 (i.e., the vertical direction in FIG. 13B) is approximately perpendicular to a direction in which the toner container 30 is attached to and detached from the process cartridge 10 (i.e., the left and right direction indicated by the dashed white arrow in FIG. 13B).

With such a configuration, if force to detach the toner container 30 from the process cartridge 10 acts on the toner container 30, force to rotate the second engagement portion 71 along with the second rotation portion 43 counterclockwise in FIG. 13B is unlikely to act. Accordingly, it is difficult to detach the toner container 30 from the process cartridge 10. Therefore, such a configuration minimizes an inconvenience that the toner container 30 attached to the process cartridge 10 is erroneously detached from the process cartridge 10.

Figure 20A:
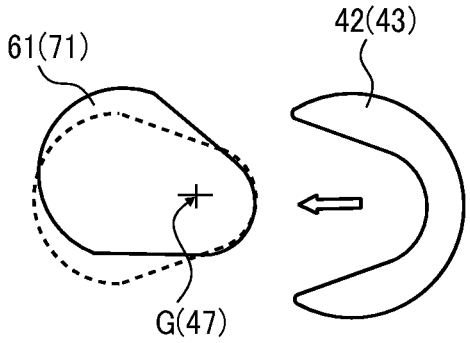
FIGS. 20A to 20C are schematic views illustrating a movement in which the first rotation portion (the second rotation portion) engages with the first engagement portion (the second engagement portion) that rotates (deviates) from a target position.
Figure 20B:
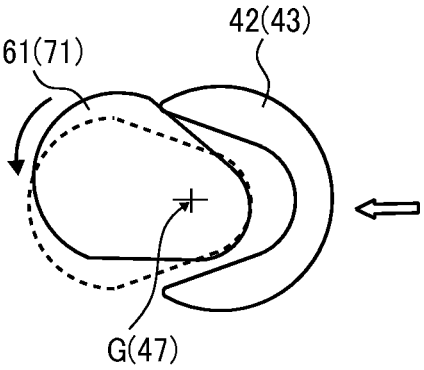
Figure 20C:
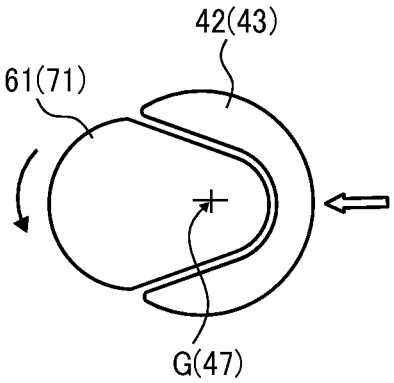

With reference to FIGS. 20A to 20C, in the present embodiment, a target position of the first engagement portion 61 is indicated by the dashed line in FIG. 20A. The target position is a position where the rotation of the first engagement portion 61 is normally stopped by the first projection 65. If the first engagement portion 61 rotates (deviates) from the target position as illustrated in FIG. 20A, the first rotation portion 42 rotates the first engagement portion 61 to the target position while pushing the first engagement portion 61 in conjunction with the attachment of the toner container 30 to the process cartridge 10 as illustrated in FIGS. 20B and 20C. Thus, the first rotation portion 42 engages with the first engagement portion 61.

Similarly, a target position of the second engagement portion 71 is indicated by the dashed line in FIG. 20A and is a position where the rotation of the second engagement portion 71 is normally stopped by the second projection 75. If the second engagement portion 71 rotates (deviates) from the target position as illustrated in FIG. 20A, the second rotation portion 43 rotates the second engagement portion 71 to the target position while pushing the second engagement portion 71 in conjunction with the attachment of the toner container 30 to the process cartridge 10 as illustrated in FIGS. 20B and 20C. Thus, the second rotation portion 43 engages with the second engagement portion 71.

Since the first and second engagement portions 61 and 71 are approximately arc-shaped, and the first and second rotation portions 42 and 43 have arc-shaped cutouts, the above-described engagement is achieved.

With such a configuration, if an external force acts, the restriction of the first and second projections 65 and 75 may be canceled, and postures of the first and second engagement portions 61 and 71 in the rotation direction may greatly deviate from the target positions (for example, postures in open states of the first and second cartridge shutters 63 and 77). However, even in such a state, the toner container 30 can be normally attached to the process cartridge 10.

Figure 21:
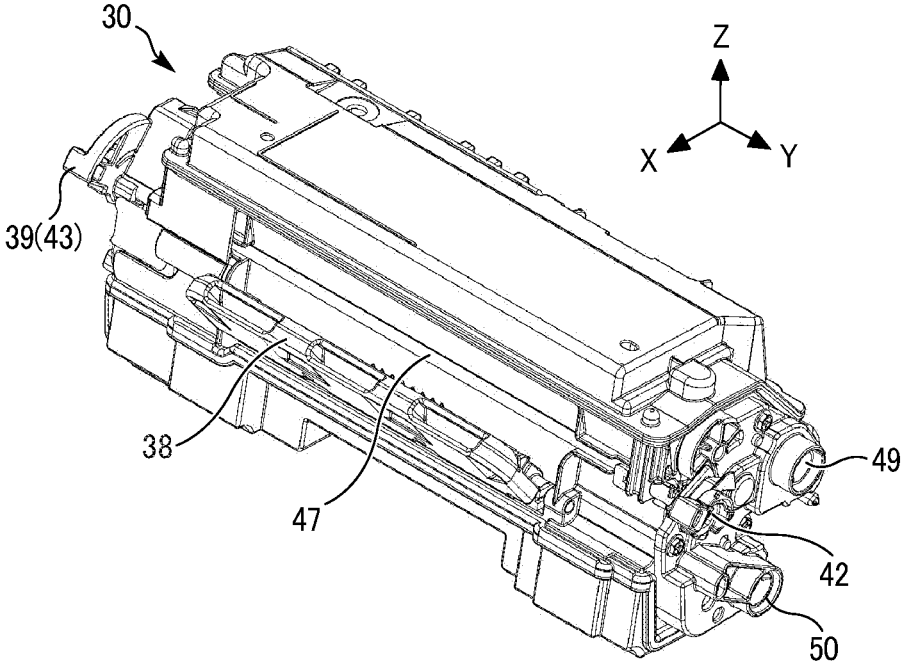
FIG. 21 is a perspective view of a toner container according to a first variation of the present disclosure.

FIG. 21 is a perspective view of a toner container 30 according to a first variation of the present disclosure.

As described above with reference to FIG. 17, the toner container 30 according to the above-described embodiment includes the piercing shaft (the shaft) 47 to couple the first rotation portion 42 and the second rotation portion 43 that is formed together with the lever 39 as a single unit. The piercing shaft 47 penetrates the inside of the toner container 30.

On the other hand, as illustrated in FIG. 21, the toner container 30 according to the first variation includes a piercing shaft 47, as a shaft, to couple the first rotation portion 42 and the second rotation portion 43. The piercing shaft is exposed to the outside of the toner container 30.

In such a case, with such a configuration provided with the first and second projections 65 and 75, similar effects to the above-described embodiments are also attained.

Figure 22:
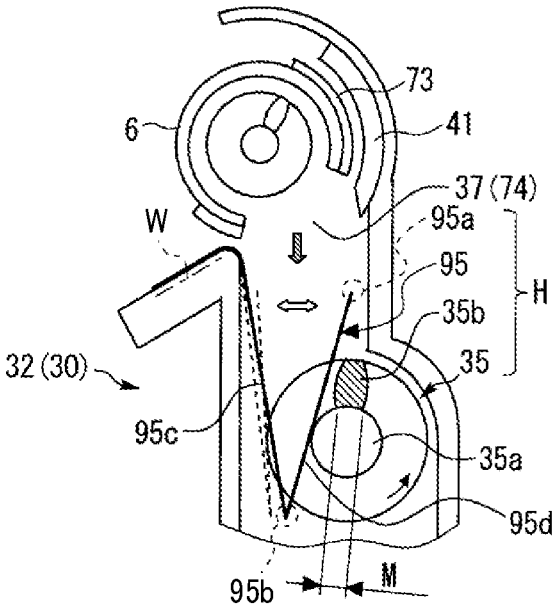
FIG. 22 is an enlarged schematic view illustrating a collection port of a toner container and the vicinity thereof according to a second variation of the present disclosure.
Figure 23:
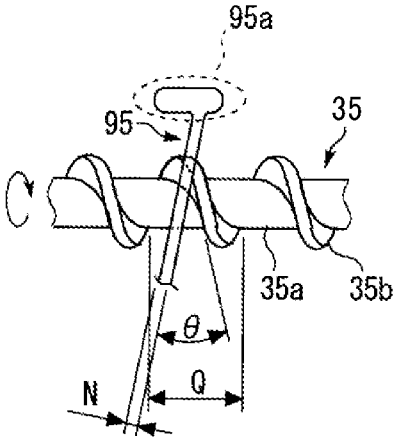
FIG. 23 is an enlarged schematic view illustrating a state in which a flexible sheet attached to the toner container in FIG. 22 is in contact with a conveying screw.

FIG. 22 is an enlarged schematic view illustrating the vicinity of the collection port 37 of a toner container 30 (the waste toner collection portion 32) according to a second variation and illustrating a state in which the outlet port 74 of the process cartridge 10 (the waste toner conveyor 6) communicates with the collection port 37. FIG. 23 is an enlarged schematic view illustrating a state in which a flexible sheet 95 disposed in the toner container 30 (the waste toner collection portion 32) is in contact with the conveying screw 35.

As illustrated in FIGS. 22 and 23, similarly to the above-described embodiment, the waste toner collection portion 32 of the toner container 30 according to the second variation includes the conveying screw 35 as the conveying rotator. The conveying screw 35 includes a shaft portion 35*a* and a screw blade 35*b* which is helically wound around the shaft portion 35*a* in the rotation axis direction of the conveying screw 35. The conveying screw 35 conveys waste toner that flows through the collection port 37 of the toner container 30 via the outlet port 74 of the process cartridge 10 (the waste toner conveyor 6) so that the waste toner is evenly collected (distributed) in the waste toner collection portion 32.

As illustrated in FIGS. 22 and 23, the toner container 30 according to the second variation includes the flexible sheet 95. The flexible sheet 95 contacts the conveying screw (the conveying rotator) 35 and swings in a flow path (a downward path) H from the outlet port 74 (the collection port 37) to the conveying screw 35, thereby stirring toner in the flow path H.

In the second variation, as illustrated in FIG. 22, the rotation center of the conveying screw 35 shifts to the right (i.e., a direction away from a sticking surface W of the flexible sheet 95 to be described later), relative to the center position of the flow path (the downward path) H in the lateral direction indicated by the white arrow in FIG. 22.

In the second variation, the flexible sheet 95 is a resin sheet made of flexible material such as polyethylene terephthalate (PET) having a thickness of about 0.1 mm. As illustrated in FIG. 22, the flexible sheet 95 is bent in an approximately V-shape at a bent portion 95*b* formed by a bending process. One end of the flexible sheet 95 (i.e., the sticking surface W) is pasted on a part of a casing of the toner container 30 alone, which is not attached to the process cartridge 10, upstream from the flow path H via a double-sided tape. The part of the casing is not in the flow path H to be described later. The flexible sheet 95 extends across the flow path (the downward path) H. The bent portion 95*b* is positioned under the conveying screw 35, and a tip 95*a* of the flexible sheet 95 is positioned above the shaft portion 35*a* of the conveying screw 35 and near the collection port 37. That is, the flexible sheet 95 includes the sticking surface W, a first extending portion 95*c* extending downward in FIG. 22 from the sticking surface W, the bent portion 95*b*, and a second extending portion 95*d* extending upward in FIG. 22 from the bent portion 95*b* to the tip 95*a*. The flexible sheet 95 is sandwiched between the conveying screw 35 (the shaft portion 35*a*) and a wall on the left in FIG. 22 of the flow path (the downward path) H.

With such a configuration, as the conveying screw 35 rotates counterclockwise, the flexible sheet 95 repeats the following actions in states that: the flexible sheet 95 contacts the screw blade 35*b*; the flexible sheet 95 contacts the shaft portion 35*a* without contacting the screw blade 35*b*; and the flexible sheet 95 contacts both of the shaft portion 35*a* and the screw blade 35*b*. As a result, the flexible sheet 95 swings in a direction indicated by the white arrow in FIG. 22 so that an angle of a V-shape between the first extending portion 95*c* and the second extending portion 95*d* varies. That is, the flexible sheet 95 repeatedly changes shapes between the V-shape of a large angle indicated by the solid line and the V-shape of a small angle indicated by the dashed line in FIG. 22. In other words, the tip 95*a* of the flexible sheet 95 reciprocates in a direction perpendicular to the shaft portion 35*a* in the flow path H.

Thus, if toner is feared to be stagnant in the flow path H, the toner is stirred by flexible sheet 95 swinging in the direction indicated by the white arrow in FIG. 22, thereby preventing the toner from clogging the flow path H. In the present embodiment, since the flexible sheet 95 is approximately V-shaped, the flexible sheet 95 complicatedly changes the shape and vibrates (swings) due to contact with the conveying screw 35, thereby improving an ability to stir the toner.

In the second variation, as illustrated in FIG. 23, the flexible sheet 95 contacts the conveying screw 35 in a range of screw pitch Q (i.e., pitch of the screw blade 35*b* of the conveying screw 35). That is, the flexible sheet 95 does not contact the screw blade 35*b* at two or more points (or does not contact across distant parts of the screw blade 35*b*).

The flexible sheet 95 contacts the screw blade 35*b* with a contact angle θ of 20 degrees or more. That is, as viewed along the rotation axis of the conveying screw 35, the contact angle θ between the flexible sheet 95 and the screw blade 35*b* wound around the shaft portion 35*a* with a predetermined winding angle is 20 degrees or more (acute angle). If the contact angle θ is smaller than 20 degrees, the flexible sheet 95 may be caught by the screw blade 35*b* of the conveying screw 35 and curled. Therefore, the contact angle θ is preferably 20 degrees or more.

With such a configuration, as the conveying screw 35 rotates, the flexible sheet 95 repeats the following actions in states that: the flexible sheet 95 contacts the screw blade 35*b* without contacting the shaft portion 35*a*; the flexible sheet 95 contacts the shaft portion 35*a* without contacting the screw blade 35*b*; and the flexible sheet 95 contacts both of the shaft portion 35*a* and the screw blade 35*b*. As a result, the flexible sheet 95 preferably swings, and an inconvenience that the flexible sheet 95 is caught by the screw blade 35*b* of the conveying screw 35 and curled is prevented.

In the second variation, the flexible sheet 95 contacts the screw blade 35*b* of the conveying screw 35 with a contact width N (see FIG. 23). The contact width N is less than or equal to a width M (see FIG. 22) of the root of the screw blade 35*b* (M>N). With such a configuration, the flexible sheet 95 described above preferably swings and stirs toner.

In the second variation, as illustrated in FIG. 23, the tip 95*a* of the flexible sheet 95, which does not directly contact the conveying screw 35, has a greater width than the other portions of the flexible sheet 95. With such a configuration of the tip 95*a* that is approximately rectangle-shaped, the ability to stir toner in the flow path H is further improved.

Figure 24A:
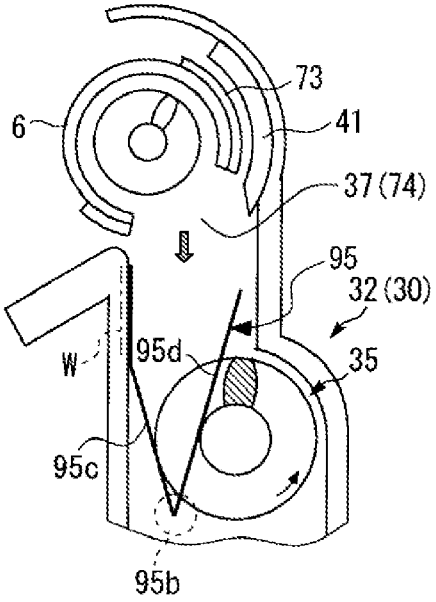
FIGS. 24A and 24B are schematic views illustrating the flexible sheet attached to the toner container in FIG. 22 in other attachment manner.
Figure 24B:
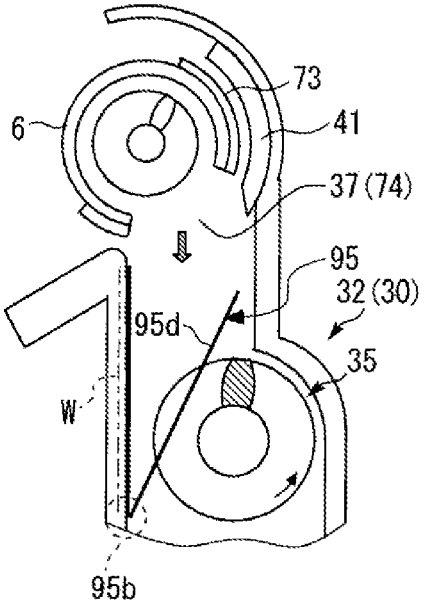

In the second variation, the sticking surface W of the flexible sheet 95 can be disposed on a wall inside the flow path (the downward path) H as illustrated in FIGS. 24A and 24B. Specifically, the first extending portion 95*c* extending downward from the sticking surface W is not pasted on the wall in FIG. 24A, and the second extending portion 95*d* extending upward from the sticking surface W is provided in FIG. 24B. In other words, the flexible sheet 95 is pasted on the wall with the sticking surface W extending to the bent portion 95*b* below the shaft portion 35*a* in FIG. 24B. In these cases, if the toner container 30 is repeatedly attached to and detached from the process cartridge 10, the flexible sheet 95 is not curled at the position of sticking surface W.

In the second variation, the flexible sheet 95 is provided to stir toner in the flow path H from the outlet port 74 to the conveying screw 35 near the collection port 37 of the toner container 30. On the other hand, the flexible sheet can be provided to stir toner in a flow path from the discharge port 36 of the toner container 30 to the development conveying screw 5*c* as the conveying rotator near the inlet port 64 of the process cartridge 10. In this case, the flexible sheet contacts the development conveying screw 5*c* and swings in a flow path (a downward path) from the discharge port 36 to the development conveying screw 5*c*, thereby stirring the toner in the flow path. The development conveying screw 5*c* is the conveying rotator, around which the screw blade is helically wound in a rotation axis direction of the development conveying screw 5*c*, to convey the toner that flows through the inlet port 64 in the rotation axis direction of the development conveying screw 5*c*.

In the second variation, the conveying screw 35 (or the development conveying screw 5*c*), around which the screw blade is helically wound in the rotation axis direction, is provided as the conveying rotator. Alternatively, a conveying rotator including a shaft portion and a coil made of a predetermined wire diameter, which is helically wound around the shaft portion in the rotation axis direction, can be provided.

Similarly to the above-described embodiments, with the first and second projections 65 and 75 and the first and second contact portions 42*a* and 43*a*, any of the cases described above in the second variation exhibits similar effect to those of the above-described embodiments.

Figure 25A:
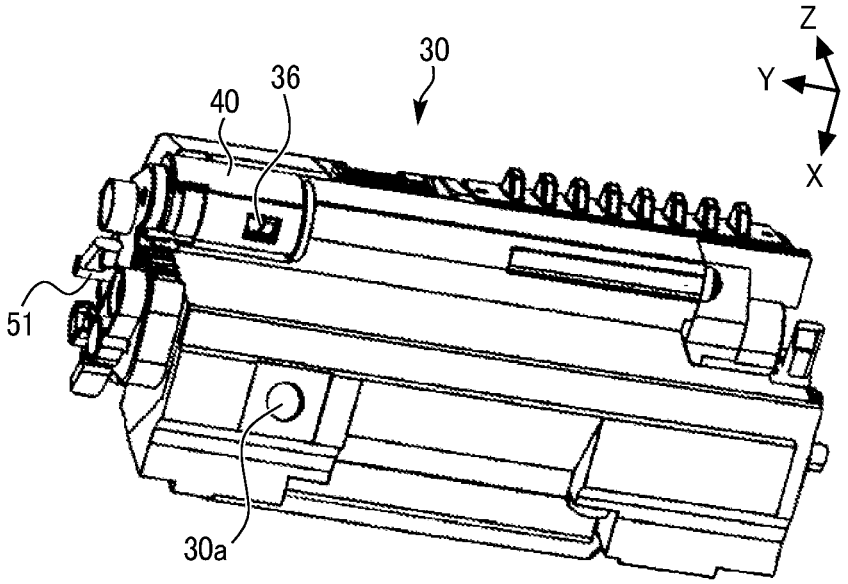
FIG. 25A is a perspective view of a toner container in which a hole is formed according to a third variation of the present disclosure.
Figure 25B:
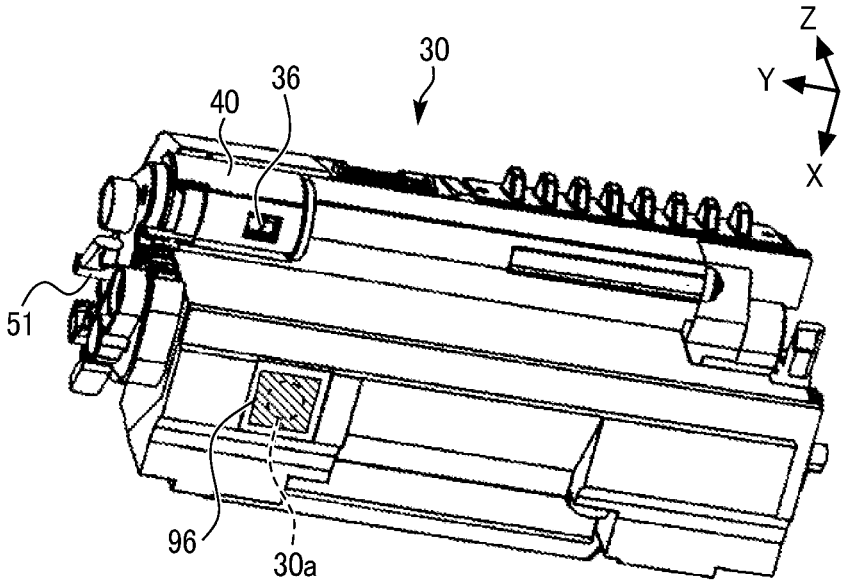
FIG. 25B is a perspective view of the toner container with the hole covered by a seal according to the third variation of the present disclosure.
Figure 26A:
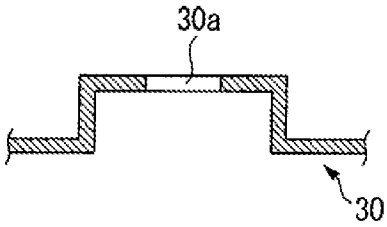
FIGS. 26A to 26C are enlarged cross-sectional views of the hole of the toner container and the vicinity thereof in FIGS. 25A and 25B.
Figure 26B:
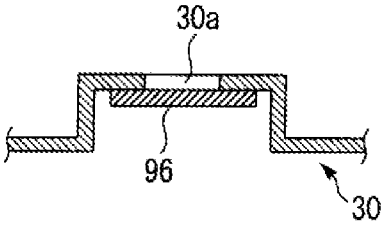
Figure 26C:
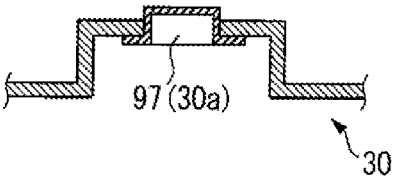

FIG. 25A is a perspective view of a toner container (a powder container) 30 having a hole 30*a* in the bottom of the toner container 30 according to a third variation. FIG. 25B is a perspective view of the toner container 30 with the hole 30*a* covered by a sheet 96 as a seal. FIGS. 25A and 25B according to the third variation correspond to FIG. 7 in the above-described embodiments. FIGS. 26A to 26C are enlarged cross-sectional views illustrating the vicinity of the hole 30*a* of the toner container 30 according to the third embodiment.

The toner container 30 illustrated in FIG. 25A is a new toner container 30 as illustrated in FIG. 7 and has the hole 30*a*. The hole 30*a* is disposed in the bottom of the waste toner collection portion 32 and communicates with the inside of the waste toner collection portion 32. The toner container 30 illustrated in FIG. 25B is the toner container 30 with the hole 30*a*, which is illustrated in FIG. 25A, covered by the sheet 96 as the seal (for example, a sheet made of PET having a thickness of about 1 mm).

Specifically, in the third variation, toner container 30 has the approximately circular hole 30*a* formed by a drill press or an ultrasonic cutter as illustrated in FIGS. 25A and 26A. The hole 30*a* enables waste toner to be drained from the waste toner collection portion 32. With such a configuration of the toner container 30 from which the waste toner can be drained, the image forming apparatus 100 and the toner container 30 can normally operate, and a user can confirm that the waste toner is collected in the waste toner collection portion 32.

If the toner container 30 with the hole 30*a* is used in the image forming apparatus 100, waste toner collected in the waste toner collection portion 32 may leak from the hole 30*a*. To prevent this inconvenience, the hole 30*a* is sealed by the sheet 96 as illustrated in FIGS. 25B and 26B.

In the third variation, as illustrated in FIGS. 25A and 26A, the hole 30*a* is formed in a recess portion that is dented from the surrounding on the casing surface of the toner container 30 (the waste toner collection portion 32). Specifically, the recess portion is disposed in the bottom of the toner container 30, which is opposed to the bottom plate 70 of the process cartridge 10 described above with reference to FIGS. 5 and 6. With such a hole 30*a* in the recess portion, when the sheet (the seal) 96 seals the hole 30*a*, the sheet 96 does not protrude from the casing surface of the toner container 30. Therefore, an inconvenience that an appearance of the toner container 30 is bad, or the toner container 30 is not placed in balance on the floor is prevented. That is, as illustrated in FIGS. 25B and 26B, the sheet 96 that seals the hole 30*a* is disposed in the recess portion and does not protrude from the casing surface of the toner container 30 around the recess portion. In other words, a height (a thickness) of the sheet 96 pasted on the hole 30*a* is smaller than a depth of the recess portion. Such a configuration prevents the sheet 96 from interfering with the bottom plate 70 of the process cartridge 10 (see FIGS. 5, 6A, and 6B).

In the third variation, the sheet 96 to seal the hole 30*a* is used as the seal. Alternatively, as illustrated in FIG. 26C, a cap 97 that fits into the hole 30*a* can be used as the seal as illustrated in FIG. 26C.

Figure 27:
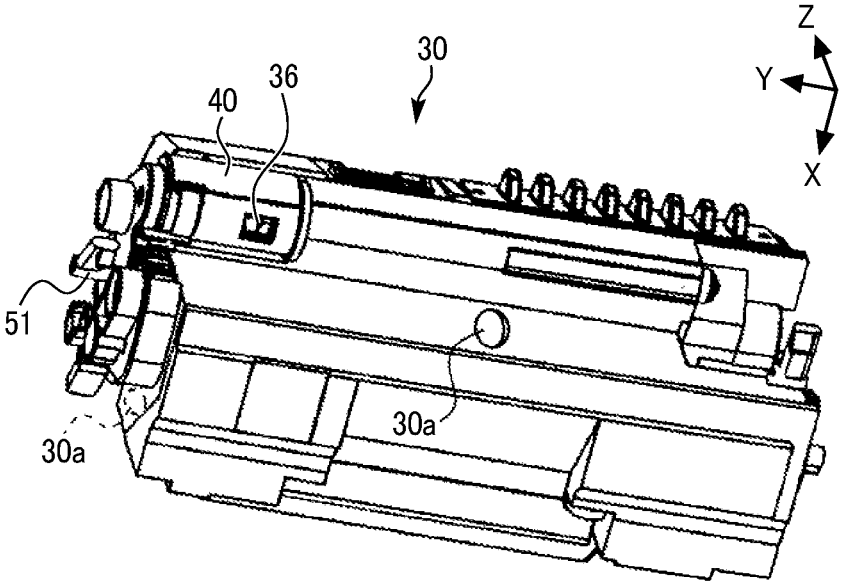
FIG. 27 is a perspective view of a toner container in which a hole is formed at a different position from the hole in FIG. 25A.

In the third variation, the hole 30*a* is formed in the bottom (in the negative Z-direction) f the toner container 30 (the waste toner collection portion 32), but the position of the hole 30*a* is not limited to the bottom (in the negative Z-direction). Alternatively, for example, the hole 30*a* can be formed in a front portion (in the negative X-direction) of the toner container 30 (the waste toner collection portion 32) as indicated by the solid line in FIG. 27 or at one side (in the positive Y-direction) of the toner container 30 (the waste toner collection portion 32) as indicated by the dashed line in FIG. 27. Similarly to the position of the hole 30*a* illustrated in FIG. 25, a position of the hole 30*a* illustrated in FIG. 27 is sufficiently away from the lever 39. Accordingly, when a user operates the lever 39, the user does not erroneously touch and remove the sheet 96. Since the position of the hole 30*a* illustrated in FIG. 27 is not on a side on which the user operates the lever 39, the appearance of the toner container 30 is not significantly affected for the user.

In the third variation, when the hole 30*a* is formed by a drill press, the position of the hole 30*a* is preferably in an area other than ranges R in FIG. 9 so that tools such as the drill do not erroneously contact the conveying screw 35. In the ranges R, if tools are inserted through the hole 30*a*, the tools may contact the conveying screw 35. For example, the ranges R are just below the conveying screw 35 and in front of the conveying screw 35.

In the present embodiment, the shape of the hole 30*a* is, but not limited to, approximately circular. In another embodiment, the shape of the hole 30*a* is, for example, approximately rectangular.

Similarly to the above-described embodiments, with the first and second projections 65 and 75 and the first and second contact portions 42*a* and 43*a*, any of the cases described above in the third variation exhibits similar effect to those of the above-described embodiments.

Figure 28A:
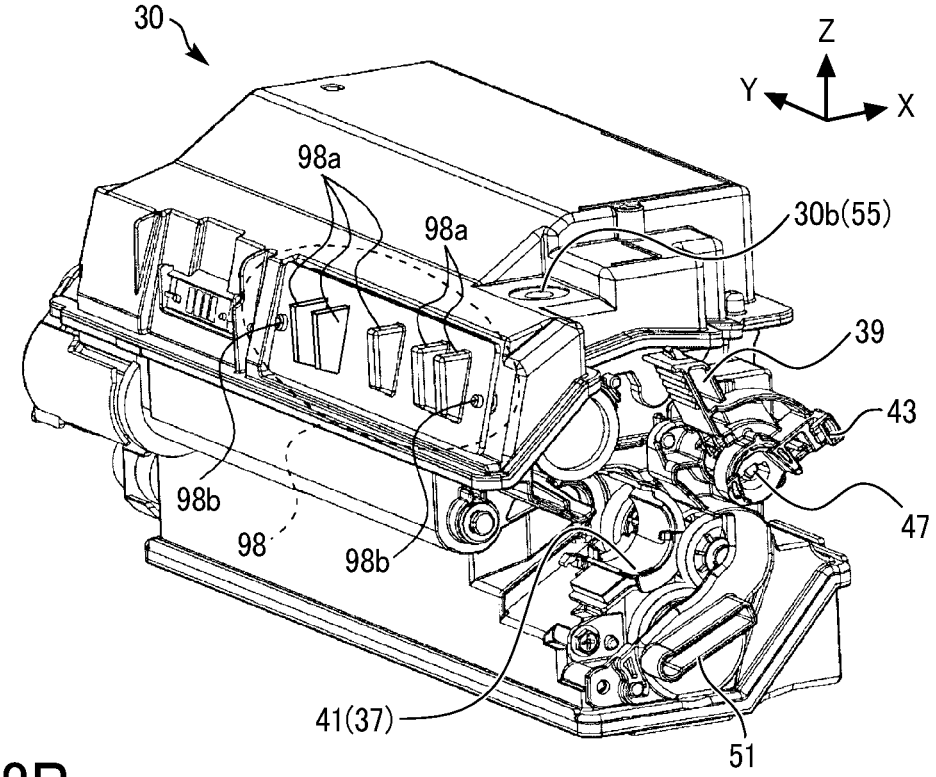
FIGS. 28A and 28B are perspective views of a toner container according to a fourth variation of the present disclosure.
Figure 28B:
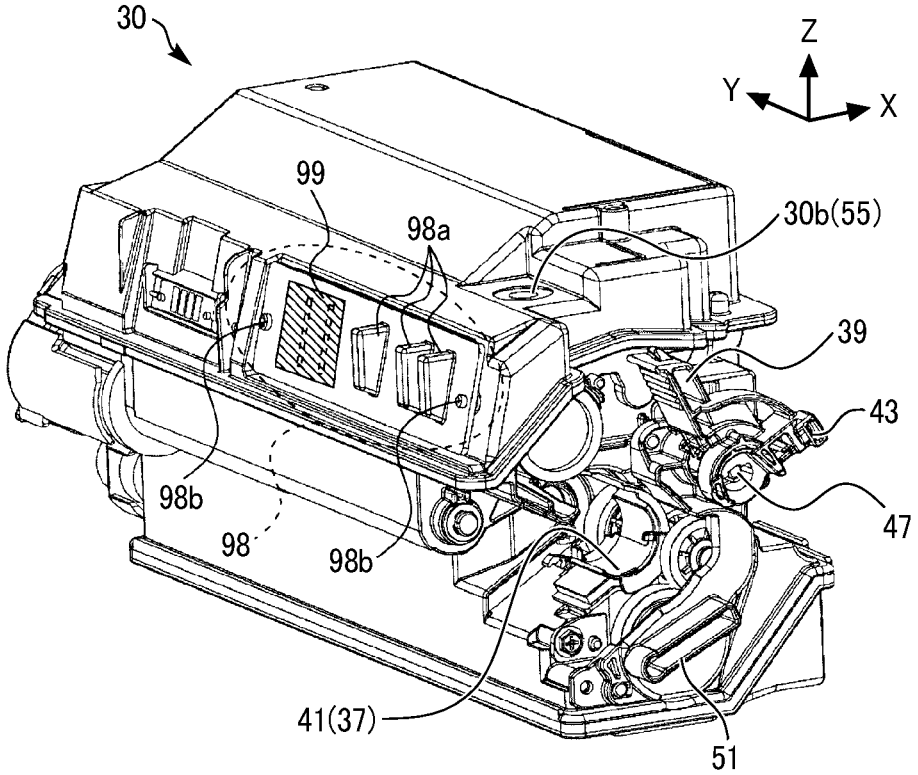
Figure 29A:
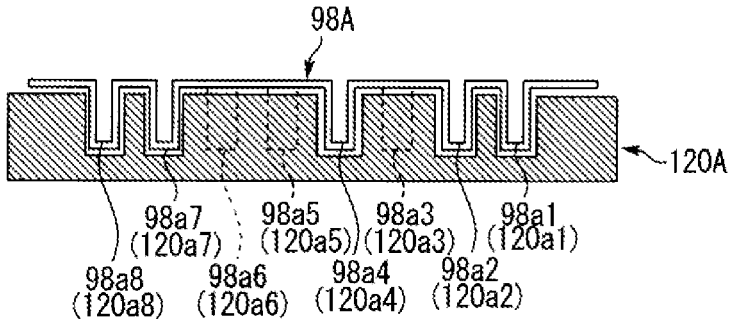
FIGS. 29A to 29C are schematic views of coupling portions, which have incompatible shapes, of the toner container and a body of the image forming apparatus.
Figure 29B:
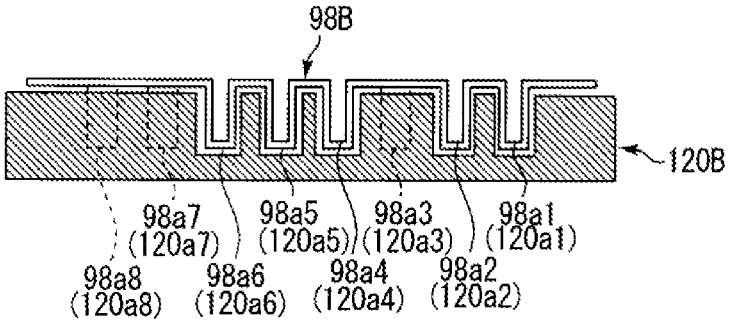
Figure 29C:
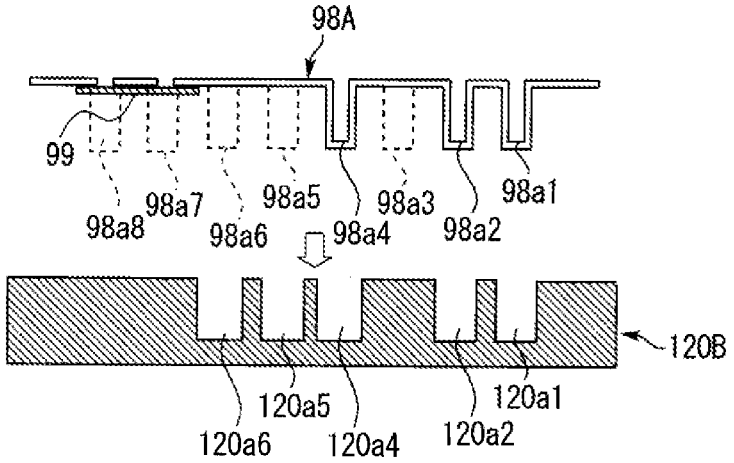

FIGS. 28A and 28B are perspective views of a toner container (the powder container) 30 according to a fourth variation and correspond to FIG. 8 in the above-described embodiment. FIGS. 29A to 29C are schematic views of coupling portions 98A, 98B, 120A, and 120B, which have incompatible shapes, of the toner container 30 and the body 101 of the image forming apparatus 100.

As illustrated in FIG. 28A, similarly to the above-described embodiments, the toner container 30 according to the fourth variation includes a coupling portion 98 having the incompatible shape on a part of the casing surface of the toner container 30. The coupling portion 98 is for distinguishing different kinds of the toner containers 30. The toner container 30 including the coupling portion 98 is not attached to different kinds of the image forming apparatuses other than the corresponding image forming apparatus 100. Cases in which the coupling portion having the incompatible shape is provided are, for example: a case where the toner containers 30 to be attached to different models of the image forming apparatuses with, for example, different printing speeds (process speeds) are to be distinguished; a case where the toner containers 30 for multiple colors (for example, yellow, magenta, cyan, and black) to be attached to the color image forming apparatus are to be distinguished; and a case where the toner containers 30 to be attached to the image forming apparatuses for different destinations (for example, destinations for domestic, north America, and Europe) are to be distinguished, and further when most parts of the toner container 30 are common components.

In the fourth variation, with reference to FIGS. 28A, 29A, and 29B (and FIGS. 7 and 8), the coupling portion 98 of the toner container 30 is described. Several kinds of coupling portions having incompatible shapes are manufactured so that the coupling portion having the incompatible shape includes projections, whose number and positions are different, at positions where the eight projections 98*a*1 to 98*a*8 can be formed. Such coupling portions 98A and 98B having incompatible shapes are illustrated in FIGS. 29A and 29B. Then, joints 98*b* of the coupling portion 98 engage with jointed portion of the toner container 30, and the joints 98*b* and the toner container 30 are jointed by hot melting. Thus, the toner container 30 lacking compatibility is assembled. On the image forming apparatus 100 side, a coupling portion 120 having the incompatible shape that corresponds to the corresponding toner container 30 is provided at a position to which the toner container is attached. The incompatible shape of the coupling portion 120 has recesses that correspond to the number and positions of the projections 98*a* of the coupling portion 98 of the toner container 30.

Specifically, as illustrated in FIG. 29A, the coupling portion 98A of a first toner container 30 includes first, second, fourth, seventh, and eighth projections 98*a*1, 98*a*2, 98*a*4, 98*a*7, and 98*a*8, and the coupling portion 120A of a body side of a first image forming apparatus 100 includes first, second, fourth, seventh, and eighth recesses 120*a*1, 120*a*2, 120*a*4, 120*a*7, and 120*a*8. Therefore, the coupling portion 98A on the container side and the coupling portion 120A of the body side engage with each other, thereby attaching the first toner container 30 to the first image forming apparatus 100.

As illustrated in FIG. 29B, the coupling portion 98B of a second toner container 30 includes first, second, fourth, fifth, and sixth projections 98*a*1, 98*a*2, 98*a*4, 98*a*5, and 98*a*6, and the coupling portion 120B of a body side of a second image forming apparatus 100 includes first, second, fourth, fifth, and sixth recesses 120*a*1, 120*a*2, 120*a*4, 120*a*5, and 120*a*6. Therefore, the coupling portion 98B on the container side and the coupling portion 120B of the body side engage with each other, thereby attaching the second toner container 30 to the second image forming apparatus 100.

If the first toner container 30 is attempted to be attached to the second image forming apparatus 100, the coupling portion 98A of the first toner container 30 does not engage with the coupling portion 120B of the body side of the second image forming apparatus 100 because the seventh and eighth projections 98*a*7 and 98*a*8 interfere with the coupling portion 120B. If the second toner container 30 is attempted to be attached to the first image forming apparatus 100, the coupling portion 98B of the second toner container 30 does not engage with the coupling portion 120A of the body side of the first image forming apparatus 100 because the fifth and sixth projections 98*a*5 and 98*a*6 interfere with the coupling portion 120A. As a result, incompatibility between the first toner container 30 and the second toner container 30 is ensured.

However, even when multiple kinds of toner containers 30 having such incompatibility are prepared, in a case of manufacturing toner container 30, a certain kind of the toner container 30 may be not sufficiently collected. In such a case, other kinds of toner containers 30 may be diverted to the extent that problems do not occur. For example, if the second toner container 30 is insufficient, the first coupling portion 98A of the first toner container 30 is replaced with the second coupling portion 98B, whereby the second toner container 30 attachable to the second image forming apparatus 100 is manufactured.

However, if the coupling portion 98 is strongly jointed to the toner container 30, it is difficult to replace the coupling portions 98A and 98B. FIGS. 28B and 29C illustrate a countermeasure against such a case. Specifically, when the first coupling portion 98A is to be engaged with the second coupling portion 120B of the body side of the second image forming apparatus 100, the seventh and eighth projections 98*a*7 and 98*a*8 interfere with the second coupling portion 120B. Therefore, in examples in FIGS. 28B and 29C, the seventh and eighth projections 98*a*7 and 98*a*8 of the first coupling portion 98A are cut off by a cutter or the like. In the fourth variation, the projection 98*a* is hollow. If the projection 98*a* is cut off, a hole communicating with the inside of the toner container 30 is formed. Accordingly, a sheet 99 as a cover is pasted on the coupling portion 98 to cover the hole. As a result, as illustrated in FIG. 29C, the first toner container 30 (the first coupling portion 98A), in which the seventh and eighth projections 98*a*7 and 98*a*8 are cut off, can be attached to (engaged with) the second image forming apparatus 100 (the second coupling portion 120B). That is, the toner container 30 can be manufactured, in which the hole is formed at the position of the projections 98*a*7 and 98*a*8 and closed by the sheet 99.

Similarly to the above-described embodiments, with the first and second projections 65 and 75 and the first and second contact portions 42*a* and 43*a*, any of the cases described above in the fourth variation exhibits similar effect to those of the above-described embodiments.

In the fourth variation, the seventh and eighth projections 98*a*7 and 98*a*8 are cut off among multiple projections 98*a*1 to 98*a*8. Since the seventh and eighth projections 98*a*7 and 98*a*8 are sufficiently away from the air vent hole 30*b* (the toner filter 55) described above, the toner filter 55 is unlikely to be broken in the operation to cut off the projection 98*a*.

As described above, the toner container 30 as a powder container according to the above-described embodiments includes the discharge port 36 configured to discharge toner stored in the toner container 30, the first container shutter 40 as a container shutter configured to open and close the discharge port 36, and the first rotation portion 42 as a rotation portion configured to rotate in conjunction with the operation of the lever 39 as an operation device. The discharge port 36 communicates with the inlet port 64 of the process cartridge 10 as a removable component. The first rotation portion 42 is engageable with the first engagement portion 61 as an engagement portion of the process cartridge 10. The first rotation portion 42 includes the first contact portion 42*a* as a contact portion that contacts the first projection 65 as a restriction member of the process cartridge 10 in conjunction with the attachment of the toner container 30 to the process cartridge 10, in order to cancel the restriction of rotation of the first engagement portion 61. The first projection 65 is configured to restrict the rotation of the first engagement portion 61.

As a result, an inconvenience that the first cartridge shutter 63 as a cartridge shutter of the process cartridge 10 to which the toner container 30 is attached is erroneously opened is prevented if an operator touches the process cartridge 10 in a state in which the toner container 30 is not attached to the process cartridge 10.

Therefore, according to embodiments of the present disclosure, a powder container, a process cartridge, and an image forming apparatus can be provided to prevent an inconvenience that a cartridge shutter on the side of the image forming apparatus or a removable component to which the powder container is attached is erroneously opened if an operator touches the image forming apparatus or the removable component in a state in which the powder container is not attached to the image forming apparatus or the removable component.

In the above-described embodiments, the present disclosure is applied to the process cartridge 10 as a single unit including the photoconductor drum 1 (an image bearer), the charging roller (a charger) 4, the developing device 5, the cleaner 2, and the waste toner conveyor 6. However, the present disclosure is not limited to the embodiments described above and may be applied to the image forming apparatus 100 in which the above-described devices (i.e., the photoconductor drum 1 as the image bearer, the charging roller 4, the developing device 5, the cleaner 2, and the waste toner conveyor 6) are removably installed as a single unit.

In such configurations, similar effects to the embodiments described above are also attained.

It is to be noted that the term "process cartridge" used in the present disclosure means a removable device (a removable unit) including an image bearer and at least one of a charger to charge the image bearer, a developing device to develop latent images on the image bearer, and a cleaner to clean the image bearer that are united together, and is designed to be removably installed as a united part in the apparatus body of the image forming apparatus.

In the above-described embodiments, the present disclosure is applied to the toner container (the powder container) 30 included in the image forming apparatus 100 that performs monochrome image formation. Alternatively, the present disclosure may be applied naturally to a toner container (a powder container) included in a color image forming apparatus.

In the above-described embodiments, the present disclosure is applied to the toner container (the powder container) 30 indirectly installed in and removed from the image forming apparatus 100 via the process cartridge 10. Alternatively, the present disclosure may be applied to a toner container (a powder container) directly installed in and removed from the image forming apparatus 100 without going through the process cartridge 10.

In the above-described embodiments, the present disclosure is applied to the toner container (the powder container) 30 to store toner (a one-component developer) and supply the toner to the developing device 5 for a one-component developing method. Alternatively, the present disclosure may be applied to a toner container (a powder container) to supply toner to the developing device 5 for a two-component developing method.

In the above-described embodiments, the present disclosure is applied to the toner container (the powder container) 30 in which toner (a one-component developer) as powder is stored and collected. Alternatively, the present disclosure may be applied to a toner container (a powder container) in which a two-component developer as powder is stored and collected. The two-component developer is a mixture of toner and carrier. In this case, a developing device employs the two-component developing method.

In the above-described embodiments, the present disclosure is applied to the toner container (the powder container) 30 including the toner storage 31 and the waste toner collection portion 32 as a single unit. Alternatively, the present disclosure may be applied to a toner container (a powder container) including only a toner storage (a powder storage).

Any of the cases described above exhibits similar effect to those of the above-described embodiments.

Numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform what has been disclosed in the present specification.

Note that, in the present disclosure, the powder container is a device configured to stir powder to be used in the image forming apparatus or stir the used powder in the image forming apparatus. Therefore, the powder container includes a device configured to stir fresh toner or a fresh developer and a device configured to stir the used toner or used developer.

In the present disclosure, the width direction is perpendicular to a direction in which the toner container (the powder container) 30 is attached to the process cartridge 10. The toner container (the powder container) 30 has a longitudinal direction and a short side direction, and the width direction is the longitudinal direction of the toner container (the powder container) 30. In addition, the width direction is a direction in which the shaft of the rotator extends.

In the present disclosure, one end side in the width direction means one portion side when the toner container 30 is divided into two portions at the center of the toner container 30. In the present disclosure, the other end side in the width direction means the other portion side when the toner container 30 is divided into two portions at the center of the toner container 30.

What is claimed is:

1. A powder container configured to be attached to and detached from one of a body of an image forming apparatus and a removable component to be installed in and removed from the body of the image forming apparatus, the powder container comprising:

a discharge port configured to communicate with an inlet port of the one of the body and the removable component and discharge powder stored in the powder container;

a container shutter configured to open and close the discharge port;

a first rotation portion configured to be engageable with an engagement portion of the one of the body and the removable component, the engagement portion configured to open and close a cartridge shutter of the one of the body and the removable component to open and close the inlet port through which the powder flows in;

a second rotation portion positioned on an opposite end of the powder container from the first rotation portion in a longitudinal direction of the powder container;

a shaft configured to couple the first rotation portion and the second rotation portion in the longitudinal direction of the powder container;

an operation device located at a same position as the second rotation portion in the longitudinal direction, and configured to rotate the first rotation portion in conjunction with an operation of the operation device, via the second rotation portion and the shaft; and a contact portion included in the first rotation portion and configured to contact a restriction member of the one of the body and the removable component in conjunction with attachment of the powder container to the one of the body and the removable component, to cancel the restriction member from restricting rotation of the engagement portion.

2. The powder container according to claim 1, wherein the first rotation portion engaging with the engagement portion is configured to rotate the engagement portion in conjunction with the operation of the operation device and move the cartridge shutter and the container shutter to open and close the inlet port and the discharge port.

3. The powder container according to claim 1, wherein a direction in which the first rotation portion and the engagement portion engage with each other is perpendicular to a direction in which the powder container is attached to and detached from the one of the body and the removable component, in a state in which the inlet port and the discharge port are opened by rotation of the engagement portion engaging with the first rotation portion.

4. The powder container according to claim 1, wherein the restriction member is disposed in a plate casing of the one of the body and the removable component, and the engagement portion is rotatably supported by the plate casing, and wherein the contact portion is configured to push the restriction member, in a state in which the first rotation portion sandwiches the plate casing, to cancel the restriction member from restricting the rotation of the engagement portion.

5. The powder container according to claim 4, wherein the first rotation portion includes:

a circular portion configured to engage with the engagement portion; and a protrusion projecting from the circular portion and configured to sandwich the plate casing.

6. The powder container according to claim 1, wherein the restriction member is a projection projecting from a plate casing of the one of the body and the removable component, wherein the engagement portion is rotatably supported by the plate casing, wherein the contact portion includes an inclined surface inclined relative to a direction in which the powder container is attached to and detached from the one of the body and the removable component, and wherein the inclined surface is configured to contact the projection to cancel the restriction member from restricting the rotation of the engagement portion.

7. The powder container according to claim 1, wherein, in a state in which the engagement portion rotates from a target position, the first rotation portion is configured to rotate the engagement portion to the target position while pushing the engagement portion in conjunction with the attachment of the powder container to the one of the body and the removable component to engage with the engagement portion.

8. The powder container according to claim 1, wherein the operation device is integrated with the second rotation portion as a single unit.

9. The powder container according to claim 1, wherein the one of the body and the removable component includes:

a conveying rotator including a shaft portion and one of a screw blade and a coil wound around the shaft portion in a rotation axis direction of the conveying rotator and configured to convey the powder that flows through the inlet port, and a flexible sheet configured to contact the conveying rotator and swing in a flow path from the discharge port to the conveying rotator.

10. The powder container according to claim 9, wherein the flexible sheet is configured to contact the conveying rotator in a range of a pitch of the one of the screw blade and the coil and contact the one of the screw blade and the coil with a contact angle of 20 degrees or more.

11. The powder container according to claim 9, wherein the flexible sheet is configured to contact the one of the screw blade and the coil with a contact width less than or equal to a width of a root of the screw blade or a wire diameter of the coil.

12. A process cartridge comprising the powder container according to claim 1, wherein the process cartridge as the removable component is installable in and removable from the body of the image forming apparatus.

13. An image forming apparatus comprising the powder container according to claim 1.

14. The powder container of claim 1, wherein the operation device is configured to rotate the second rotation portion when the operation device is operated by an operator.

15. A powder container configured to be attached to and detached from one of a body of an image forming apparatus and a removable component to be installed in and removed from the body of the image forming apparatus, the powder container comprising:

a discharge port configured to communicate with an inlet port of the one of the body and the removable component and discharge powder stored in the powder container;

a container shutter configured to open and close the discharge port;

a first rotation portion configured to be engageable with an engagement portion of the one of the body and the removable component, the engagement portion configured to open and close a cartridge shutter of the one of the body and the removable component to open and close the inlet port through which the powder flows in;

a second rotation portion;

a shaft configured to couple the first rotation portion and the second rotation portion;

an operation device configured to rotate the first rotation portion in conjunction with an operation of the operation device, via the second rotation portion and the shaft; and a contact portion included in the first rotation portion and configured to contact a restriction member of the one of the body and the removable component in conjunction with attachment of the powder container to the one of the body and the removable component, to cancel the restriction member from restricting rotation of the engagement portion, wherein the first rotation portion engaging with the engagement portion is configured to rotate the engagement portion in conjunction with the operation of the operation device and move the cartridge shutter and the container shutter to open and close the inlet port and the discharge port.

16. A powder container configured to be attached to and detached from one of a body of an image forming apparatus and a removable component to be installed in and removed from the body of the image forming apparatus, the powder container comprising:

a discharge port configured to communicate with an inlet port of the one of the body and the removable component and discharge powder stored in the powder container;

a container shutter configured to open and close the discharge port;

a first rotation portion configured to be engageable with an engagement portion of the one of the body and the removable component, the engagement portion configured to open and close a cartridge shutter of the one of the body and the removable component to open and close the inlet port through which the powder flows in;

a second rotation portion;

a shaft configured to couple the first rotation portion and the second rotation portion;

an operation device configured to rotate the first rotation portion in conjunction with an operation of the operation device, via the second rotation portion and the shaft; and a contact portion included in the first rotation portion and configured to contact a restriction member of the one of the body and the removable component in conjunction with attachment of the powder container to the one of the body and the removable component, to cancel the restriction member from restricting rotation of the engagement portion, wherein a direction in which the first rotation portion and the engagement portion engage with each other is perpendicular to a direction in which the powder container is attached to and detached from the one of the body and the removable component, in a state in which the inlet port and the discharge port are opened by rotation of the engagement portion engaging with the first rotation portion.

* * * * *